US007927238B2

(12) United States Patent
Mejia Perez

(10) Patent No.: US 7,927,238 B2
(45) Date of Patent: Apr. 19, 2011

(54) APPARATUS, SYSTEM AND METHOD FOR TRAINING OVERHAND THROWING MECHANICS

(76) Inventor: Cesar Emilio Mejia Perez, Azua (DO)

( * ) Notice: Subject to any disclaimer, the term of this patent is extended or adjusted under 35 U.S.C. 154(b) by 26 days.

(21) Appl. No.: 12/380,270

(22) Filed: Feb. 25, 2009

(65) Prior Publication Data

US 2010/0216578 A1 Aug. 26, 2010

(51) Int. Cl.
*A63B 69/00* (2006.01)

(52) U.S. Cl. ..... 473/452

(58) Field of Classification Search ..... 473/451–454, 473/497, 468
See application file for complete search history.

(56) References Cited

U.S. PATENT DOCUMENTS

| | | | | |
|---|---|---|---|---|
| 3,236,520 | A * | 2/1966 | Friedman | 473/452 |
| 4,666,155 | A * | 5/1987 | Stille | 473/497 |
| 5,000,449 | A | 3/1991 | Weeks | |
| 5,058,889 | A * | 10/1991 | Burton | 473/452 |
| 5,467,977 | A * | 11/1995 | Beck | 473/497 |
| 6,102,818 | A | 8/2000 | Hamilton | |
| 6,139,450 | A | 10/2000 | Rivers | |
| 6,386,996 | B1 | 5/2002 | Foster | |
| 6,500,078 | B1 | 12/2002 | Williams et al. | |
| 6,843,739 | B2 * | 1/2005 | Putnam | 473/497 |
| 6,945,883 | B1 | 9/2005 | Williams et al. | |
| 7,338,395 | B1 | 3/2008 | Hurley | |
| 7,621,831 | B2 * | 11/2009 | Roberts | 473/497 |
| 2004/0033849 | A1 | 2/2004 | Socci | |
| 2004/0121862 | A1 | 6/2004 | Socci | |
| 2007/0060421 | A1 * | 3/2007 | Distefano | 473/452 |
| 2007/0202970 | A1 * | 8/2007 | Miller et al. | 473/451 |

* cited by examiner

*Primary Examiner* — Mark S Graham
(74) *Attorney, Agent, or Firm* — Scott D. Compton; The Compton Law Firm, PC

(57) ABSTRACT

An apparatus is provided for training the overhand throwing motion. The apparatus comprises a first end having a first altitude relative to a throwing surface; an opposing second end having a second altitude relative to the throwing surface; and an unobstructed guiding surface interconnecting the first end to the second end and defining a slope there between.

7 Claims, 18 Drawing Sheets

APPARATUS, SYSTEM AND METHOD FOR TRAINING OVERHAND THROWING MECHANICS

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE APPLICATION

The present application relates generally to an apparatus, system and method for training the overhand throwing motion.

BACKGROUND

To date, various training devices have been developed in the field of athletics aimed at teaching and improving overhand throwing mechanics. Unfortunately, any one training device does not benefit those coaches, instructors, and athletes who do not agree with the throwing philosophy on which that particular device is devised. What one individual may consider as "proper throwing technique," "proper throwing form," "proper throwing mechanics," "proper throwing motion," "proper body position during the throwing motion," etc., may be considered improper by someone else. For example, various baseball pitching instructors have differing philosophies regarding proper stride length, proper balance, the proper landing spot and position of the stride foot along the pitcher's mound, and the proper overall synchronization of the human body during the throwing motion necessary to maximize an athlete's throwing ability while minimizing possible injury to the athlete. Thus, existing training devices have been developed based on a particular inventor's personal concept of "proper" throwing mechanics.

A need exists for a training apparatus that addresses Applicant's own individual philosophy regarding proper overhand throwing mechanics for individuals.

SUMMARY

The present application is directed to an apparatus for training the overhand throwing motion. The apparatus comprising a first end having a first altitude relative to a throwing surface; an opposing second end having a second altitude relative to the throwing surface; and an unobstructed guiding surface interconnecting the first end to the second end and defining a slope there between; wherein the slope defining the guiding surface is different than the slope defining the throwing surface.

The present application is also directed to a method for dictating the path in space of the stride foot while performing the overhand throwing motion. The method comprises (1) providing a training apparatus on a throwing surface, the training apparatus comprising a first end, a second end, and a guiding surface interconnecting the first end to the second end, the guiding surface being adjustable in altitude; (2) performing the act of throwing including (a) standing on the throwing surface adjacent the training apparatus in a starting position, (b) directing the stride foot from the throwing surface to a contact point on the guiding surface, (c) directing the stride foot along the guiding surface toward the second end until the stride foot reaches a removal point off the guiding surface, (d) directing the stride foot from the removal point to a landing spot on the throwing surface adjacent the training apparatus.

The present application is also directed to a method for directing the side of the lead hip on a substantially direct path toward a throwing target during the stride phase of the overhand throwing motion. The method comprises (I) providing a training apparatus on a throwing surface apart from a throwing target, the training apparatus comprising (1) a first end at a first altitude, (2) a second end at a second altitude, the second end being closer in proximity to the throwing target than the first end, and (3) an unobstructed guiding surface substantially straight along a horizontal plane and interconnecting the first end to the second end, the guiding surface including a visual indicator; (II) aligning the guiding surface lengthwise toward the throwing target; (III) performing the act of throwing by (a) standing on the throwing surface adjacent the training apparatus in a starting position whereby the coronal plane lies in parallel alignment with the guiding surface toward the throwing target, (b) directing the stride foot from the throwing surface to a contact point on the guiding surface, (c) directing the stride foot along the guiding surface toward the second end until the stride foot reaches a removal point of the guiding surface, (d) directing the stride foot from the removal point to a landing spot on the throwing surface adjacent the training apparatus.

The present application is also directed to a system for training overhand throwing mechanics. The system comprises a throwing target; a pitchers mound having a pitching rubber, the pitcher's mound being set apart from the throwing target whereby the surface of the pitchers mound between the pitching rubber and the throwing target includes a slope; and a training apparatus upon the pitchers mound comprising (a) a first end, (b) an opposing second end, and (c) an unobstructed guiding surface interconnecting the first end to the second end and sloping toward the throwing target; wherein the surface of the pitchers mound includes a starting spot and a landing spot for a pitcher's stride foot, each spot being located adjacent the training apparatus.

BRIEF DESCRIPTION

Figure 1:
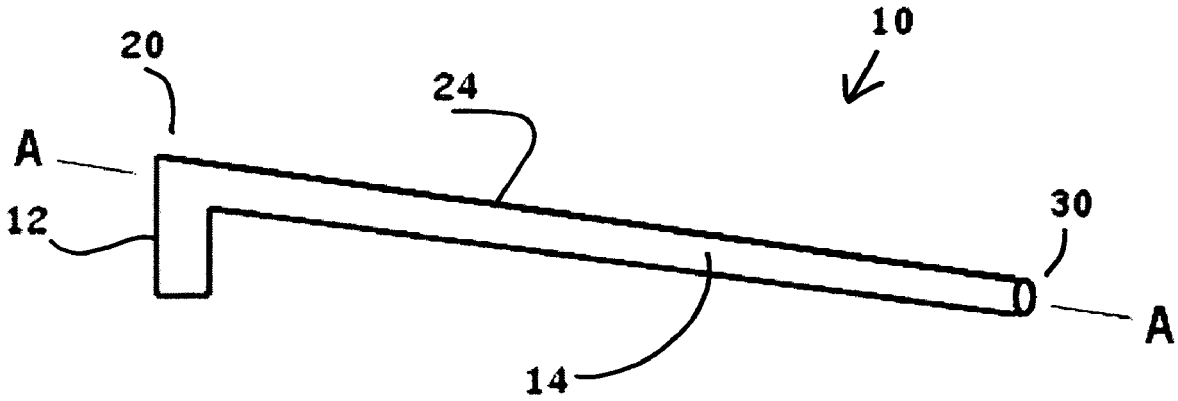
FIG. 1 illustrates a side view of a first embodiment of the training apparatus including a rising section and an elongated section providing a substantially straight downward slope.

Overhand throwing in sports is a complex movement involving the lower body, the body core, upper body, and upper extremities through various phases of the throwing motion. Thus, it is advantageous for individuals to improve their body mechanics during each of these phases to maximize throwing velocity, throwing accuracy, and stamina, while also minimizing risk of injury. It has been discovered that the present training apparatus may be set adjacent an individual on the ground or throwing surface for teaching, and/or training, and/or developing, and/or improving, and/or maintaining an individual's throwing mechanics by: (1) providing a guide path whereby an individual may direct his/her stride foot along the guide path toward a throwing target during the stride phase; (2) providing a guide path whereby an individual may direct his/her stride foot along the guide path toward a throwing target thereby also directing the individual's lead side toward the throwing target during the stride phase; (3) providing a guide path comprising a downward slope effective to maintain an individual's head about equal to or behind his/her center of gravity in relation to a throwing target during the act of throwing; (4) providing a guide path operationally configured to prevent the premature landing of an individual's stride foot on the ground or throwing surface during the act of throwing; (5) providing a guide path operationally configured to guide an individual's stride foot to a desired landing spot or position on the ground or throwing surface adjacent the training apparatus; (6) providing a guide path effective to produce a light or soft landing of an individual's stride foot at a desired landing spot and in a desired landing position on the ground or throwing surface adjacent the training apparatus; (7) providing a guide path effective to develop an individual's body tempo during the act of throwing; (8) providing a guide path operationally configured to maintain an individual's stride foot at an optimum altitude during the stride phase of the throwing motion; and (9) providing a guide path effective to give instant feedback to an individual regarding his/her performance of proper or improper throwing mechanics as professed by Applicant. It has also been discovered that the present training apparatus may be used to develop an athlete's throwing mechanics, such as a baseball pitcher, in real time game situations whereby a pitcher may use the apparatus without disrupting the pitcher's natural relationship with the pitcher's mound while delivering a pitch. Heretofore, such a desirable achievement has not been considered possible, and accordingly, the apparatus, system and method of this application measure up to the dignity of patentability and therefore represent a patentable concept.

As used in this application, the phrases "proper throwing mechanics" and/or "proper throwing motion" refer to Applicant's own philosophy regarding the correct aspects of overhand throwing. The phrases "overhand throwing mechanics" and/or "overhand throwing motion" refer to (1) the synchronization of individual body parts during the different phases of the throwing motion; (2) the orientation of individual body parts during the different phases of the throwing motion; and (3) the speed and/or tempo of individual body parts necessary to propel an athletic object from an individual's throwing hand. An "athletic object" herein means any object capable of being thrown out from the hand of an individual or from a device further attached to the hand of an individual. Suitable athletic objects include, but are not necessarily limited to athletic balls, javelins, boomerangs, martial arts weapons, rocks/stones and other objects capable of being thrown and released from a thrower's hand in an overhand manner or released from a device attached to the thrower's hand. Herein, to "throw" means to propel an athletic object from the throwing hand so as to be airborne. The phrase "overhand throw" as it relates to the throwing motion, herein refers to the manipulation of the throwing arm during the throwing motion so that the throwing arm is positioned out to the side of the thrower's body core during the acceleration phase (further discussed below), wherein the upper arm is oriented at an angle from about 80 degrees to about a 120 degrees in relation to the longitudinal axis of the individual's body core. The phrase "lower body" herein refers to an individual's legs and feet. The term "core" or "body core" is defined as the hips, waist, and trunk of an individual. The phrase "upper body" refers to the shoulders, neck, and head of an individual. The phrase "upper extremities" refers to an individual's arms, wrists, hands and fingers. The phrases "upper arm" and "upper arm region" refer to the part of the arm from the elbow to shoulder. Herein, the term "path" in relation to a throwing target refers to the directional path between an individual, or the training apparatus and a throwing target. Suitably, a "path" comprises a substantially straight line between an individual, or training apparatus, and a throwing target. The term "tempo" refers to the appropriate speed and effort ratio on the part of an individual during the overhand throwing motion. The phrase "throwing surface" refers to the ground, playing surface, or other surface, including any surface covering material such as carpet, mat, etc., supporting an individual and/or the training apparatus during the act of throwing. The phrase "natural relationship with a throwing surface" and like phrases refer to the usual or normal contact made between an individual's feet and a throwing surface during the act of throwing. The phrase "stretch position" herein refers to the position a baseball pitcher assumes on the pitcher's mound whereby the sternum region of the pitcher lies on a plane perpendicular to the path between the pitcher and home plate. The phrase "muscle memory" refers to the process by which an individual's neuromuscular system memorizes motor skills, such as those motor skills related to Applicant's own philosophy regarding the proper overhand throwing motion. The phrase "center line" refers to the longitudinal plane that divides the body of an individual into right and left sections, (aka—Sagittal Body Plane). The phrase "throwing attribute" refers to a quality or characteristic of the overhand throwing motion as espoused by Applicant. An "unobstructed guiding surface" refers to a guiding surface free from impediment, obstruction, hindrance or abrupt change in surface structure.

In one aspect, the present application relates to an apparatus that may be used during real time sports competition by an athlete without disrupting the athlete's natural relationship with the playing surface.

In another aspect, the present application relates to a portable apparatus that may be easily carried and/or packed and/or stored.

In another aspect, the present application relates to an apparatus that may be placed on either substantially level or substantially unlevel surfaces.

In another aspect, the present application relates to an apparatus, including an elongated member, comprising a first end having a first altitude or elevation and a second end having a second altitude or elevation, the elongated member defining a slope there between.

In another aspect, the present application relates to an apparatus that may be adjusted in height and/or length.

In another aspect, the present application relates to an apparatus operationally configured to direct an individual's stride foot along a particular path toward a throwing target during the stride phase of the throwing motion.

In another aspect, the present application relates to an apparatus operationally configured to direct an individual's head along a particular path toward a throwing target during the stride phase of the throwing motion.

In another aspect, the present application provides an apparatus operationally configured to direct the stride foot of an individual to a desired landing spot on the throwing surface adjacent the apparatus during the act of throwing.

In another aspect, the present application provides an apparatus effective to develop an individual's muscle memory to produce a repeatable gliding motion of the stride foot in space toward a throwing target during the stride phase as a result of proper and repeated use of the apparatus.

In another aspect, the present application provides an apparatus effective to develop an individual's muscle memory to produce a repeatable soft and/or controlled landing of the stride foot at a desired position on the throwing surface during the act of throwing.

In another aspect, the present application provides an apparatus suitably positioned so that a first upper elevation of the apparatus is located furthest from a throwing target and a second lower elevation is located nearest the same throwing target.

In still another aspect, the present application relates to an apparatus effective to develop an individual's muscle memory as to maintaining the lead side of the individual's core on a direct path toward a throwing target during the stride phase of the throwing motion.

In still another aspect, the present application provides an apparatus operationally configured to guide an individual's stride foot from a starting position on the throwing surface adjacent a first upper elevation of the apparatus to a desired landing spot on the throwing surface adjacent a second lower elevation of the apparatus.

In yet another aspect, the present application provides an apparatus operationally configured to direct the path of an individual's stride leg, i.e., foot, lower leg, knee and upper leg, in space during the stride phase of the throwing motion.

In another aspect, the present application provides an apparatus operationally configured to prevent the premature landing of an individual's stride foot upon the throwing surface during the stride phase of the throwing motion.

In another aspect, the present application provides an apparatus operationally configured to be set at a maximum altitude necessary to establish the minimum altitude of an individual's stride foot during the initial leg lift of the windup phase of the throwing motion.

In another aspect, the present application provides an apparatus operationally configured to provide an unobstructed continuous guide surface including a downward slope of such degree necessary to direct an individual's stride foot from a point at maximum leg lift during the windup phase to a landing spot on the throwing surface effective to prevent the individual's center of gravity from shifting forward toward the intended throwing target past the individual's center line.

The apparatus, system and method according to the present application will be described in more detail with reference to the embodiments illustrated in the drawings. The drawings are illustrative only, and are not to be construed as limiting the invention, which is defined in the claims.

Discussion of the Training Apparatus

Figure 2:
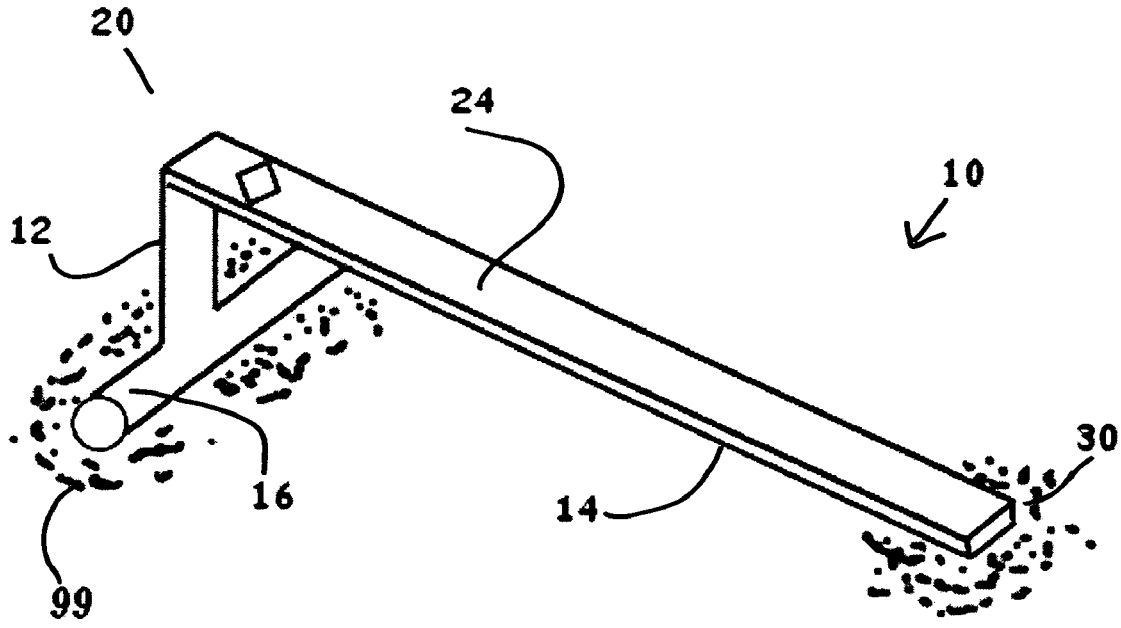
FIG. 2 illustrates a perspective view of a second embodiment of the training apparatus including a base.
Figure 3:
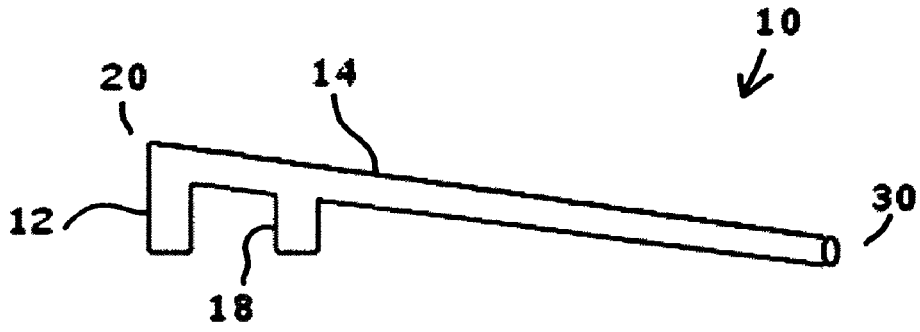
FIG. 3 illustrates a side view of a third embodiment of the training apparatus including a second rising section.

The Figures of the drawings, and particularly FIG. 1, disclose a training apparatus 10 comprising at least a rising section 12 and an elongated section 14. As shown in FIG. 2, the training apparatus 10 may further include a base 16 operationally configured to stabilize the training apparatus 10 in an operable upright position. As shown in FIG. 3, the training apparatus 10 may further comprise a second rising section 18 to further support the elongated section 14 as desired.

As shown in the embodiments of FIGS. 1-5B, the first end 20 of the training apparatus 10 is raised above the throwing surface 99 while the second end 30 terminates at a lower altitude—providing an unobstructed downward slope of the upper surface 24. With reference to the embodiments as depicted in FIGS. 1-3, the first end 20 of the training apparatus 10 is defined by the attachment point between the rising section 12 and a first end of the elongated section 14 establishing a first altitude of the training apparatus 10. The second end 30 of the training apparatus 10 is defined by the distal end of the elongated section 14, which terminates at a second altitude—providing a downward slope of the elongated section 14 (and upper surface 24) as shown. As illustrated in the embodiments of FIGS. 1-3, the elongated section 14 and upper surface 24 are substantially straight horizontally.

Figure 5A:
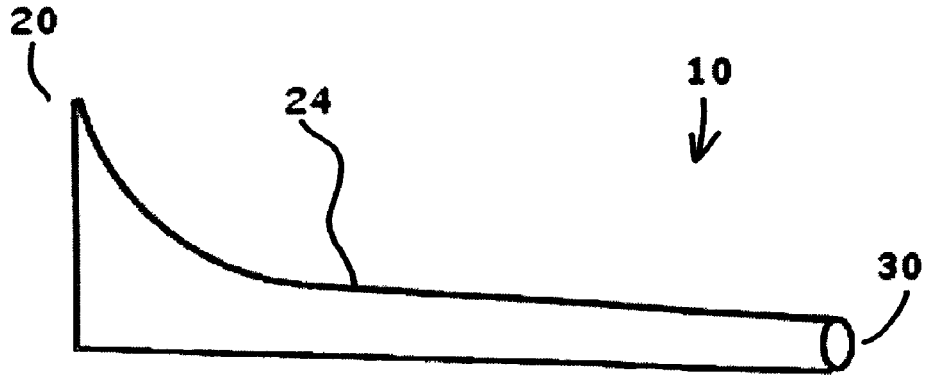
FIG. 5A illustrates a side view of a fifth embodiment of the training apparatus including a smooth upper surface that curves along a vertical plane.
Figure 5B:
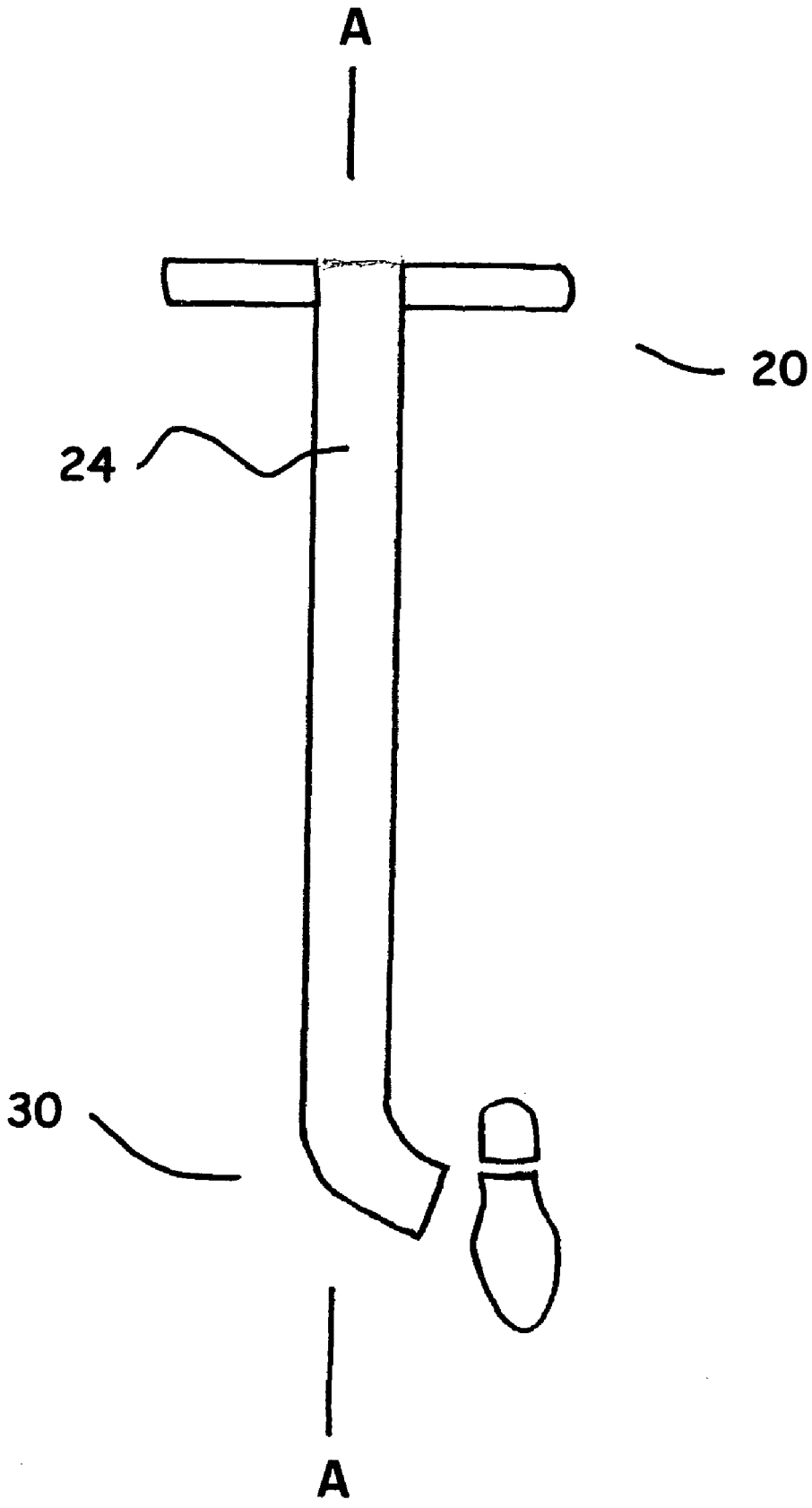
FIG. 5B illustrates a top view of a sixth embodiment of the training apparatus including an upper surface that curves toward the landing spot of a user's stride foot.

It is herein contemplated that the slope of the upper surface 24 may vary, as determined by the individual using the training apparatus 10. This is because the optimum path of an individual's stride foot in space during the act of throwing may be unique to that particular individual. In one embodiment, the training apparatus 10 may comprise a substantially straight sloping upper surface 24. For example, the training apparatus 10 may comprise a substantially straight elongated section 14 defined by longitudinal axis A-A as shown in FIG. 1. For particular individuals, a straight downward sloping upper surface 24 may not provide an optimum guide path for the stride foot. Thus, it is also contemplated that the upper surface 24 may be curved vertically i.e., wherein the upper surface 24 is configured in an exponential decay as depicted in the simplified embodiment of FIG. 5A. Likewise, the upper surface 24 may curve laterally thereby guiding the stride foot directly to a desired landing spot and position on the throwing surface 99 as shown in FIG. 5B.

Furthermore, it is also contemplated that the training apparatus 10 may be built to scale or otherwise adjusted to accommodate individuals as desired. For example, if an individual stands adjacent the first end 20 of the training apparatus 10, the maximum altitude of the upper surface 24 is suitably less than the maximum altitude of the individual's stride foot during the leg lift or knee lift of the windup phase of the throwing motion. If an individual stands adjacent the elongated member 14 at a point between ends 20 and 30, the maximum altitude of the upper surface 24 adjacent the individual is suitably less than the maximum altitude of the individual's stride foot during the knee lift of the windup phase.

As stated above, the training apparatus 10 may be adjusted to accommodate individuals as desired. In one embodiment, the training apparatus 10 may comprise a fixed first rising section 12. In another embodiment, the first rising section 12 may comprise an adjustable or telescoping member operationally configured to vary the maximum altitude of the first rising section 12 as desired. Likewise, the elongated section 14 may be fixed, or in the alternative, the elongated section 14 may comprise an adjustable or telescoping member operationally configured to vary the length of the elongated section 14, as well as the overall length of the training apparatus 10 as desired. In operation, an individual may adjust the first rising section 12 and/or the elongated section 14 to correlate to his/her specific body type as determined by at least (1) the maximum altitude of his/her stride foot during the initial knee lift, and (2) the length of his/her stride during the act of throwing. Thus, a training apparatus 10 may be used by a particular individual and adjusted in altitude and/or length horizontally over time as a means of developing and/or fine tuning his/her proper throwing mechanics. Or, a training apparatus 10 may be used by multiple individuals and adjusted in altitude and/or length horizontally to suit one particular individual's use of the training apparatus 10 and then readjusted in height and/or length for another individual's use thereafter.

In a simplified embodiment of the training apparatus 10 operationally configured for training overhand throwing mechanics in baseball pitching, a suitable training apparatus 10 comprises an adjustable height up to about 36 inches (about 91.44 cm) at the first end 20 and an adjustable length up to about 10 feet (about 3.05 meters). Once the training apparatus 10 is adjusted and set for a particular individual, the training apparatus 10 includes an upper surface 24 of a particular length and downward slope to meet that particular individual's training needs. With reference to baseball pitching, a substantially straight elongated member 14 suitably comprises a slope from a maximum of about fifty (50) degrees to about one (1.0) degrees in relation to the throwing surface 99. It is also contemplated that the slope of the elongated member 14 may be greater than about 50 degrees if necessary to optimize the throwing mechanics of a particular individual, e.g., an extremely tall person of about seven feet or greater.

In order to optimally utilize the training apparatus 10 as envisioned by Applicant, the upper surface 24 suitably provides a substantially smooth unobstructed contact surface, i.e., guiding surface and/or gliding surface, for the bottom side of the individual's stride foot/shoe during the stride phase of the throwing motion. Thus, the stride foot may slide along the upper surface 24 a distance up to the length of the upper surface 24 in an undisturbed fashion prior to landing on the throwing surface 99 adjacent the training apparatus 10.

Although not necessarily limited to a particular size requirement, the upper surface 24 suitably comprises a width up to about the length of an individual's stride foot or shoe. In a particularly advantageous embodiment, the upper surface 24 comprises a width about equal to the length of the arch of an individual's stride foot or corresponding arch type surface of the bottom of an individual's shoe.

Figure 4:
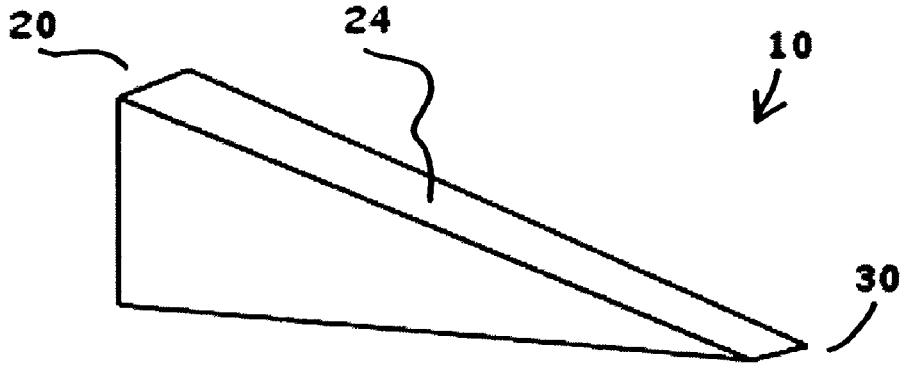
FIG. 4 illustrates a perspective view of a fourth embodiment of the training apparatus including a triangular member.

In one implementation, the training apparatus 10 may comprise an L shape configuration formed by the junction of the first rising section 12 to the elongated section 14, as illustrated in FIGS. 1-3. In another implementation, the training apparatus 10 may comprise any configuration effective to maintain the training apparatus 10 in an upright position during operation. With particular attention to FIG. 2, the training apparatus 10 may further comprise a first T-member type base 16 suitably attached at the lower end of the first rising section 12. Likewise, the first T-member type base 16 or an additional T-member type base may be attached to the lower end of the second rising section 18. In the simplified embodiment of the training apparatus 10 as illustrated in FIG. 4, the training apparatus 10 may comprise a triangulated configuration including an upper surface 24 providing a guiding surface and/or gliding surface for an individual's stride foot/shoe, wherein the bottom side of the training apparatus 10 is configured to balance the training apparatus 10 in an operable upright position. In the embodiment of FIG. 4, the bottom side of the training apparatus 10 suitably comprises a width greater than or equal to the width of the upper surface 24 operationally configured to maintain the training apparatus 10 in an upright position during use thereof.

Figure 5C:
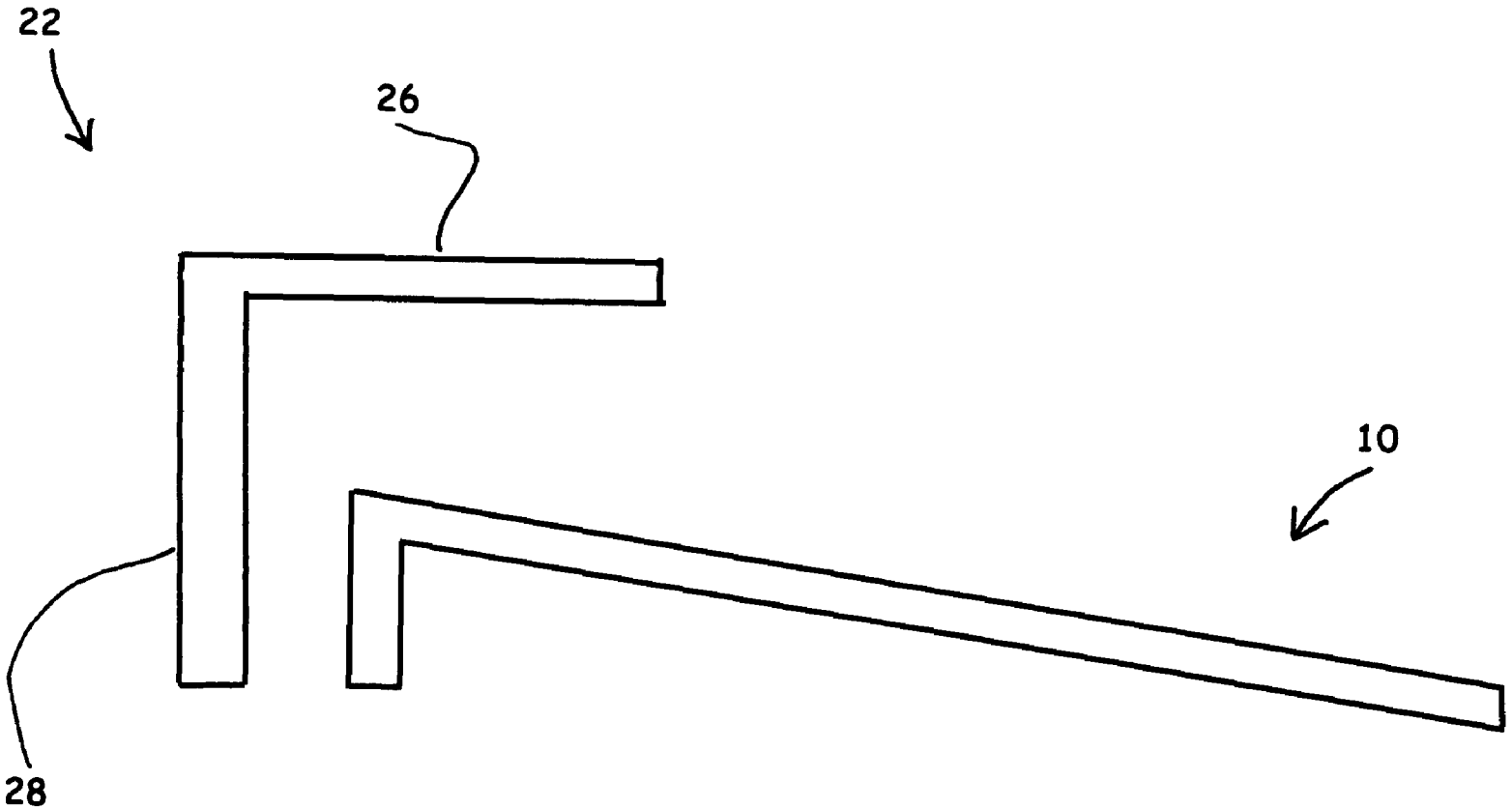
FIG. 5C illustrates a side view of a seventh embodiment of the training apparatus including an accessory member.

With reference now to FIG. 5C, the training apparatus 10 may further include an accessory member 22 operationally configured to (1) limit the maximum altitude of the stride foot during the windup phase of the overhand throwing motion, and/or (2) prevent undesired movement of the knee and/or rotation of the upper body during the windup phase of the overhand throwing motion. Suitably, the accessory member 22 includes at least a projection 26 overhanging at least part of the training apparatus 10 and operationally configured to prevent an individual's foot from rising there above. The accessory member 22 suitably also comprises an adjustable base member 28 for setting the height of the projection 26. The base member 28 may also serve to limit the distance an individual's stride foot may be directed past the first end 20 of the training apparatus 10. For example, in terms of baseball pitching it is undesirable for a pitcher's knee on the stride leg to break the plane of the pitching rubber away from the catcher or throwing target. The base member 28 therefore serves to prevent an individual from over rotating or twisting away from a throwing target during the windup phase of the overhand throwing motion by limiting the travel distance of the individual's foot away from the throwing target during the windup phase. The accessory member 22 may be releasably attached to the training apparatus 10 or set apart there from during use.

In operation, the training apparatus 10 may be set or placed on a substantially flat throwing surface 99. In the alternative, the training apparatus 10 may be set on an uneven throwing surface 99, i.e., a sloping or rising throwing surface. An example of a sloping or rising throwing surface includes a baseball pitcher's mound having a radius of about 9.0 feet (about 274.3 cm) and a maximum elevation up to about 20 inches (about 50.8 cm) from the base of the pitcher's mound resulting in a degree of slope up to about 10.5 degrees from the base of the pitcher's mound.

Depending on the individual making use of the training apparatus 10, the training apparatus 10 may be configured to flex, bend or bow when an individual applies a certain amount of weight or pressure to the upper surface 24. In the alternative, the training apparatus 10 may remain solid or firm during operation. Thus, in one embodiment the training apparatus 10 may be constructed from any material durable enough to bend without breaking or splintering. In another embodiment, the training apparatus 10 may be constructed from a rigid material. More particularly, the training apparatus 10 may be constructed from one or more materials including but not necessarily limited to those materials resistant to chipping, cracking, excessive bending and reshaping as a result of ozone, weathering, heat, moisture, other outside mechanical and chemical influences, as well as various impacts and other loads placed on the training apparatus 10. Suitable materials of construction include, but are not necessarily limited to metals, plastics, rubbers, woods, fiberglass, plexiglass, filled composite materials, and combinations thereof. A suitable plastic includes polyvinyl chloride (PVC). A suitable metal includes aluminum. Essentially, any particular plastic or metal may be serve as a construction material, however, it is desirable that the materials of construction be light enough so that an individual may manually transport the training apparatus 10 without undue effort. Likewise, the training apparatus 10 is not necessarily limited to any particular color or combination of colors. In addition, the training apparatus 10 may be constructed from a transparent or translucent material as desired.

It is also contemplated herein that the bottom side of the training apparatus 10 may include one or more gripping means effective to maintain the training apparatus 10 against any lateral movement along the throwing surface 99. Although not necessarily limited to a particular configuration, a suitable gripping means is one configured to be used in connection with a particular throwing surface. In one embodiment, the gripping means may include one or more spikes configured to dig into a dirt, grass or carpeted throwing surface. In another embodiment, the gripping means may include suction cups configured to adhere to a solid flat throwing surface constructed from wood materials, cementitious materials, tile materials, and the like. In still another embodiment, the training apparatus 10 may be fixed to a throwing surface by means including, but not necessarily limited to nails, screws, adhesive substances, bolts, welds, rope, straps, hook and loop fasteners, and combinations thereof—depending on the materials of construction of the training apparatus 10 and the type of throwing surface 99 being used.

The above described training apparatus 10 is effective for training the overhand throwing motion as it relates to Applicant's own philosophy regarding proper overhand throwing mechanics. As will be discussed in greater detail below, by specifically configuring both the altitude or height of the first and second ends 20, 30 and the length of the training apparatus 10, and thus, the downward slope of the upper surface 24 while also aligning the upper surface 24 toward a throwing target, the training apparatus 10 is operationally configured to provide an optimum guide path in space for a particular individual's stride foot during the throwing motion thereby developing an individual's muscle memory with regard to one or more of the following throwing attributes when using the training apparatus 10 in a recurring manner: (1) optimum stride length by inhibiting the premature landing of the individual's stride foot upon the throwing surface 99; (2) optimum knee lift by establishing a desired altitude of the first end 20 and upper surface 24 of the training apparatus 10; (3) optimum leg swing of the stride leg from a point of maximum knee lift to a landing spot on the throwing surface 99 adjacent the training apparatus 10; (4) optimum tempo of an individual during the act of throwing; (5) optimum alignment of the lead side of an individual's body core on path toward a throwing target during the stride phase of the throwing motion; (6) optimum alignment of an individual's head with his/her body core and lower body during the stride phase of the throwing motion, wherein the individual's head does not move out in front of his/her center of gravity toward the throwing target; (7) a controlled gliding motion of an individual's stride foot during the stride phase of the throwing motion; (8) a soft or controlled landing of an individual's stride foot at a particular location on the throwing surface 99; (9) maintenance of the individual's head at a distance further from a throwing target than the inner thigh of the stride leg during the transition from the windup phase to the stride phase; (10) optimum alignment of the individual's center of gravity whereby his/her center of gravity does not draw nearer to the throwing target than the individual's center line during the transition from the windup phase to the stride phase of the overhand throwing motion; (11) optimum directional alignment of the stride foot along a path toward a throwing target during the stride phase of the throwing motion; (12) optimum maintenance of an individual's hips in a closed position during the stride phase of the throwing motion; (13) optimum directional momentum of the individual toward the throwing target; (14) optimum loading of the back leg during the windup phase; and (15) the optimum synchronization of an individual's lower body, body core, upper body and upper extremities during the release of an athletic object from an individual's throwing hand, meant to minimize strain to the throwing shoulder and/or throwing elbow while maximizing throwing velocity, throwing accuracy, and stamina of an individual executing multiple throws during a given period of time.

In order to understand how the training apparatus 10 may be used to develop one or more of the above listed throwing attributes, a brief understanding of Applicant's own philosophy regarding optimum throwing mechanics is provided below.

Discussion of the Overhand Throwing Motion

For the purpose of this application, the overhand throwing motion is divided into six distinct phases: (1) the windup phase; (2) the stride phase; (3) the arm cocking phase; (4) the arm acceleration phase; (5) the arm deceleration phase; and (6) the follow-through phase. Optimum attributes of each phase of the throwing motion will be described in greater detail below, first generally, and then how to use the training apparatus 10 to achieve each attribute. Hereafter, Applicant's philosophy regarding the overhand throwing motion and use of the training apparatus 10 is described with reference to a baseball pitcher. In particular, the various figures make reference to a right handed throwing baseball pitcher throwing to a baseball catcher.

(1) The Windup Phase

Figure 6:
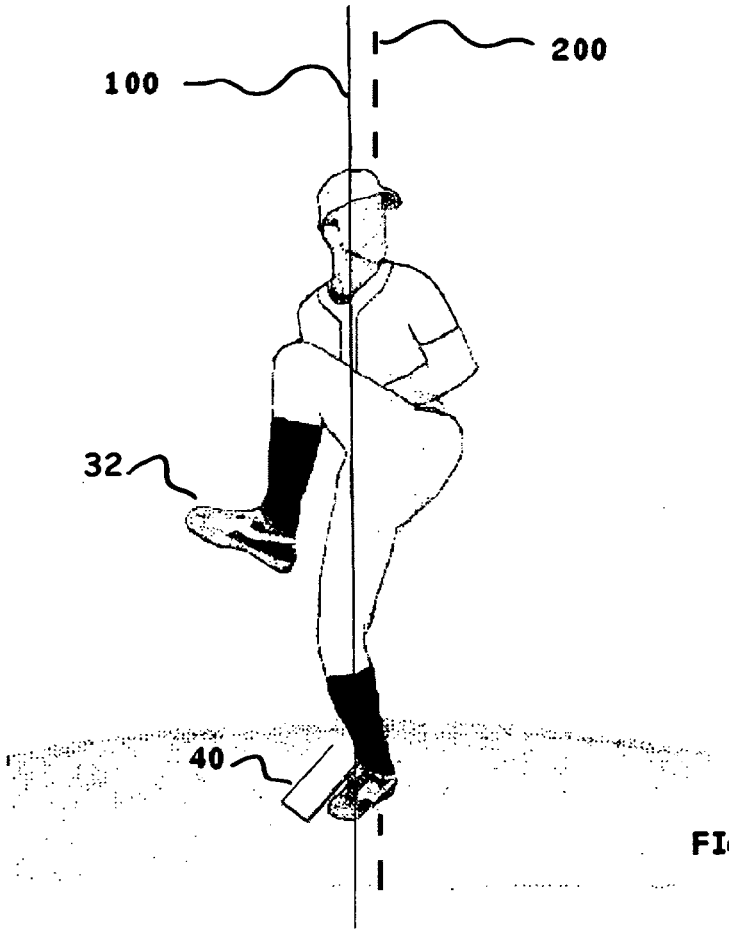
FIG. 6 illustrates a front side view of a baseball pitcher during the windup phase including the initial lifting of the pitcher's stride leg up off of the pitcher's mound whereby the pitcher is balanced on his/her non-stride leg.

The windup phase involves the initial motion of a pitcher from a starting position including the initial lifting of a pitcher's stride leg up off of the pitcher's mound whereby the pitcher is balanced on his/her non-stride leg. As known to those of ordinary skill, the pitcher's windup may be performed from either the full windup position or from the set position. In either case, a pitcher suitably reaches the same body position at the end of the windup phase as illustrated in FIG. 6. As shown, the windup phase ends when the pitcher's knee is lifted to a desired maximum altitude or height for that individual—suitably where the top of the pitcher's thigh is at least about parallel to the playing surface surrounding the pitcher's mound.

At maximum knee lift, the following attributes are desired: (1) the pitcher's stride foot lies in vertical alignment with the stride knee approximately equidistant from the catcher (in the alternative, the stride knee may lie closer to the catcher than the stride foot); (2) the pitcher's weight is optimally balanced on the non-stride leg in a load position in preparation to push off of the pitching rubber 40 toward the catcher—meaning that the pitcher's center of gravity 100 is slightly behind his/her center line 200 in relation to the catcher; and (3) the pitcher's head is situated from about center line 200 to slightly behind center line 200 in relation to the catcher. In addition, the pitcher's head should remain at a relatively constant elevation during the knee lift, lowering in elevation only in response to any bending in the rear knee, or slight bending at the waist.

(2) The Stride Phase

Figure 7:
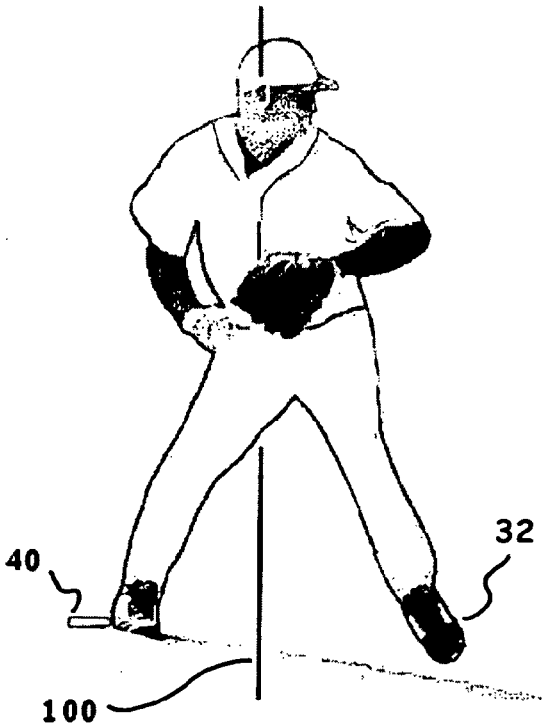
FIG. 7 illustrates a front side view of a baseball pitcher during the transition from the windup phase to the stride phase of the throwing motion.
Figure 8:
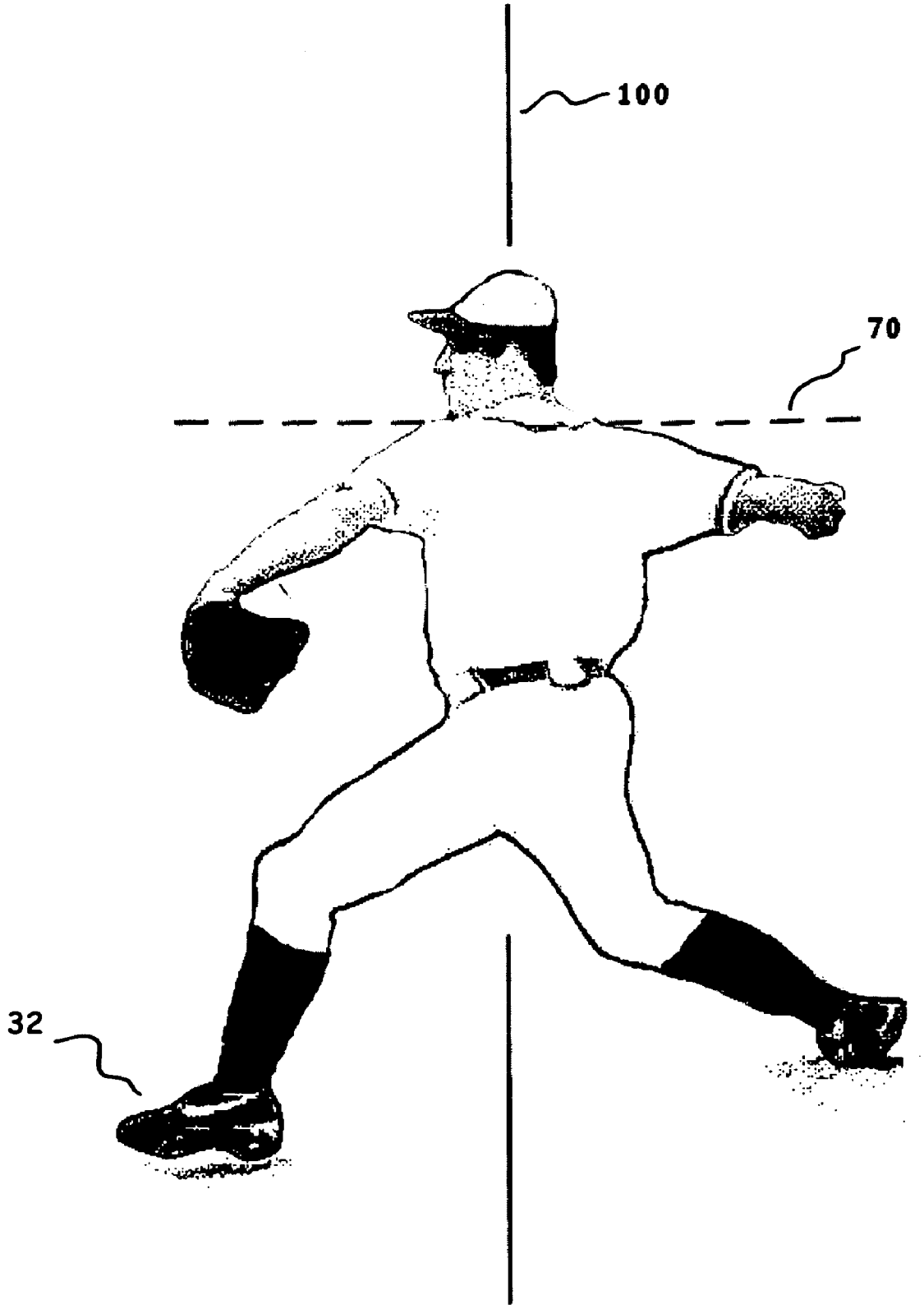
FIG. 8 illustrates a rear side perspective view of a baseball pitcher during the stride phase of the throwing motion.

With reference now to FIGS. 7 and 8, the stride phase is characterized by a pitcher directing or transferring his/her stride foot 32 in space from a point of maximum knee lift toward the catcher until the stride foot 32 lands on the pitcher's mound. During the initial transition from the windup phase to the stride phase, a pitcher's head suitably remains substantially still, i.e., balanced at the pitching rubber 40, which helps to maintain the pitcher's center of gravity 100 in a stationary position as the pitcher's stride leg begins transitioning into the stride phase.

Figure 15:
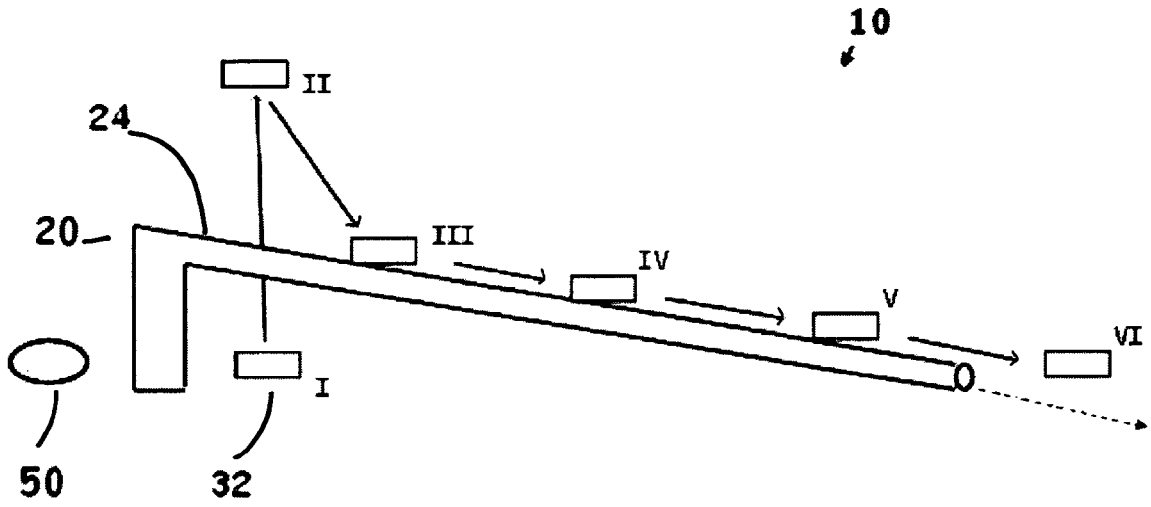
FIG. 15 illustrates a side view of a first simplified path of an individual's stride foot during the act of throwing as the stride foot travels along an embodiment of the training apparatus.
Figure 16:
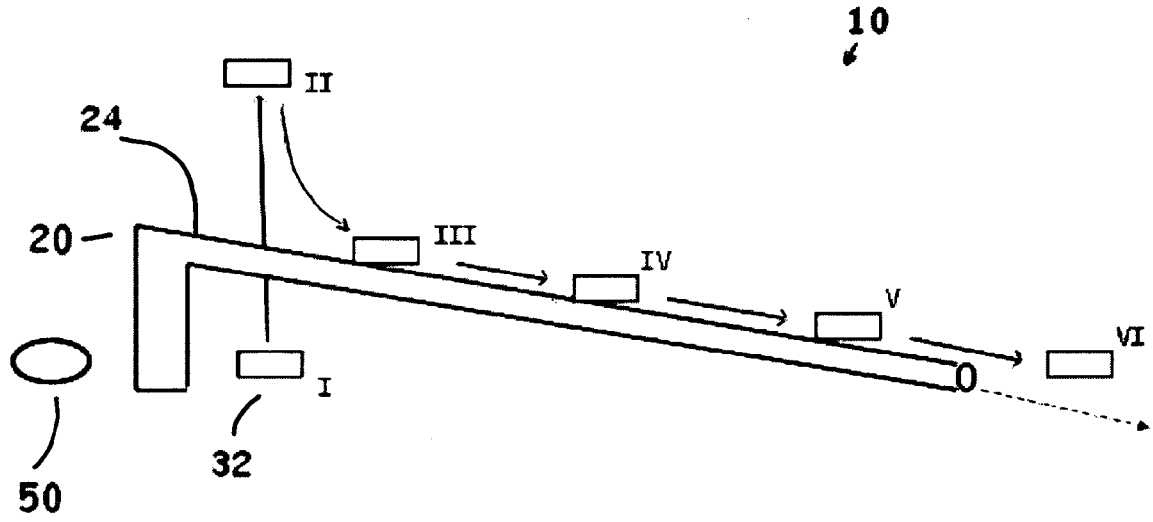
FIG. 16 illustrates a side view of a second simplified path of an individual's stride foot during the act of throwing as the stride foot travels along an embodiment of the training apparatus.

As a pitcher's stride leg transitions from maximum knee lift into the stride phase, the stride foot 32 begins moving down and toward the catcher, either in a curved manner, or in a substantially straight manner—depending on the individual (see FIGS. 15 and 16). Once the stride foot 32 reaches a position in space nearer the catcher than the stride knee, the pitcher's upper body is suitably directed toward the catcher at a similar rate as the stride foot 32, which is suitably directed toward the catcher in a controlled gliding manner.

During the stride phase, it is undesirable for the apex of a pitcher's head to move out in front of his/her center of gravity 100 toward the catcher, which may occur when a pitcher rushes his/her upper body forward or when a pitcher lowers or dips his/her lead shoulder. Such movement may result in the stride foot 32 landing on the pitcher's mound prematurely, i.e., at an undesired landing spot. Likewise, if the apex of a pitcher's head moves backward beyond his/her center of gravity 100 a significant amount away from the catcher, the pitcher may over stride thereby contacting the pitcher's mound out beyond his/her desired landing spot or position. To help avoid an improper landing spot or location of the stride foot 32 on the pitcher's mound, Applicant advocates that the apex of the pitcher's head be maintained at about center of gravity 100 or slightly behind center of gravity 100 whereby the plane 70 defining the top of the pitcher's shoulders remains substantially level (i.e., about parallel to the playing surface surrounding the pitcher's mound) as the stride foot 32 travels toward the catcher (a suitable plane 70 is shown in the simplified illustrated of FIG. 8). By maintaining plane 70 while also maintaining the apex of the pitcher's head at about center of gravity 100 or slightly behind center of gravity 100, a pitcher reduces the possibility of over striding or under striding.

It should be noted that an optimum stride length is important to the overall synchronization of the pitcher's lower body, body core, upper body and upper extremities. Optimum stride length also maximizes the distance between the release point of the baseball from the pitcher's hand and the catcher. Generally, an over extended stride may result in locking up of the stride leg, i.e., hyperextension, which prohibits a pitcher from getting his/her upper body out over the front leg, possibly increasing the strain to the front shoulder region. An under extended stride may result in inefficient use of the lower body during the act of throwing, increasing strain on the throwing arm.

In addition to the forward progress of the stride foot 32 toward a catcher along a vertical plane, the stride foot 32 is also suitably maintained on a substantially straight path toward the catcher from maximum knee lift until the pitcher's hips begin to rotate open to face the catcher, at which point the stride foot 32 moves off line to a landing spot on the pitcher's mound. When performed accordingly, linear movement of the stride foot 32 toward the catcher results in the linear movement of the pitcher's head and upper body toward the catcher until the hips begin to rotate open. Thus, the directional alignment of a pitcher's stride foot 32 in space during the stride phase is vital to optimizing the alignment and overall synchronization of the pitcher's lower body, body core, upper body and upper extremities.

It should also be noted that a pitcher suitably begins separating his/her hands at maximum knee lift as he/she transitions into the stride phase, which maintains the throwing arm in sync with the pitcher's upper body. If the pitcher's hands do not separate timely, it may be difficult for the throwing arm to ever catch up to the upper body during the arm acceleration phase (described below)—resulting in (1) the pitcher dropping his/her elbow to an undesirable location prior to release of the baseball, and/or (2) the pitcher throwing the baseball "up and away on the throwing arm side of home plate" as known to those of ordinary skill in the art of pitching. Suitably, a pitcher's arms separate in similar fashion mirroring one another. As the glove arm separates out toward the catcher, the pitcher's glove hand continues to extend out toward the catcher in a thumb down orientation as the throwing arm moves to a cocked position (as discussed below).

During the windup and stride phases the shoulder muscles play a small role, whereas, the lower body or legs play a major role during these first two phases of the overhand throwing motion. Specifically, the non-stride leg provides the pushing or driving force that accelerates a pitcher toward the catcher. Thus, the most favored directional alignment of the stride foot 32 in space is the path that allows for optimal acceleration of the pitcher from the pitching rubber 40 toward the catcher.

(3) The Arm Cocking Phase

Figure 9:
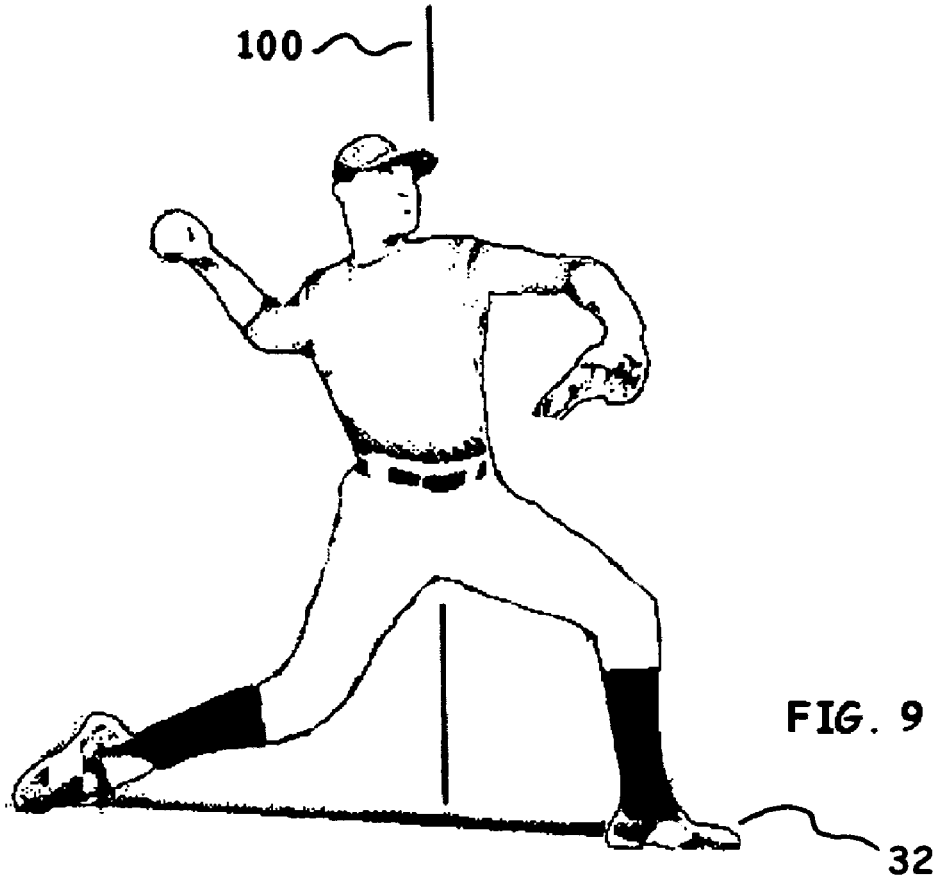
FIG. 9 illustrates a front side view of a baseball pitcher during the arm cocking phase of the throwing motion.

With reference now to FIG. 9, the stride phase ends and the arm cocking phase begins as the pitcher's stride foot 32 contacts the pitcher's mound. At initial contact of the stride foot 32 with the pitcher's mound, the apex of the pitcher's head is suitably oriented from about his/her center of gravity 100 to slightly behind his/her center of gravity 100—depending on the physical makeup of the individual.

Figure 10:
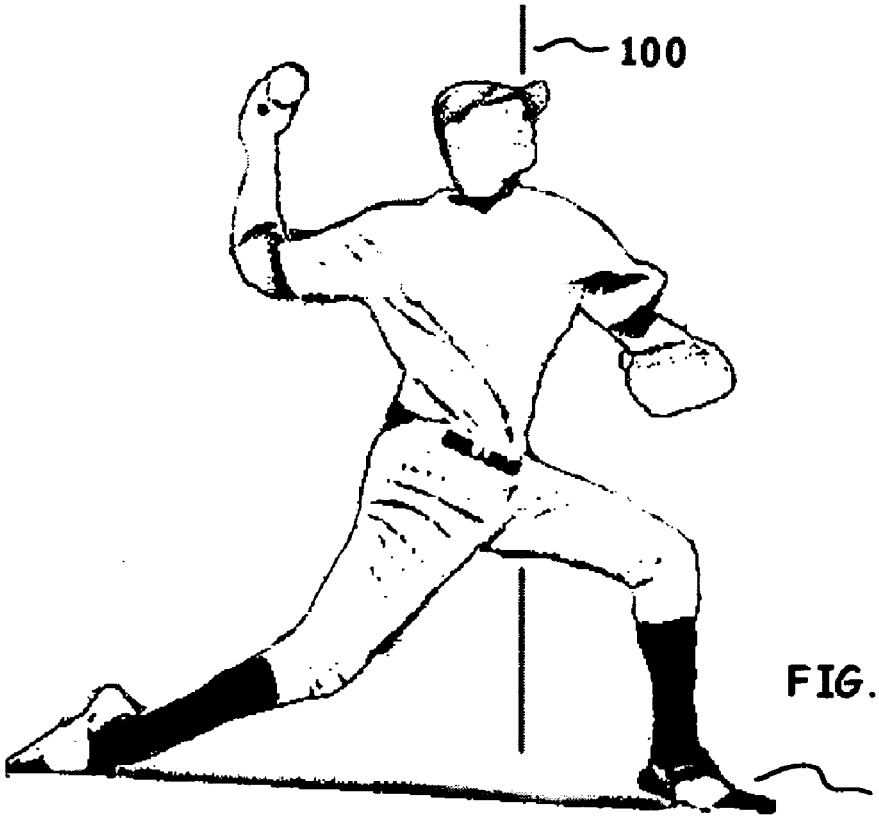
FIG. 10 illustrates a front side view of a baseball pitcher during the arm cocking phase just prior to a pitcher entering the arm acceleration phase of the throwing motion.

The arm cocking phase is further characterized by the throwing arm being brought up and back behind the pitcher's head, i.e., cocked, in preparation of the forward throw toward the catcher—as illustrated in FIGS. 9 and 10. Here, the chest, the external rotators and the deltoid muscles assist in extending the glove hand out toward the catcher while simultaneously lifting the throwing arm up and back flexing the elbow from about 85 degrees to about 135 degrees behind the pitcher's head. Other muscles that contribute to the arm cocking phase include but are not necessarily limited to the trapezius muscle, which elevates the throwing shoulder, and the rhomboids, which direct the shoulder blades back. As the throwing arm is cocked up and back, both the pitcher's legs and body core are oriented in a manner to optimally propel the body forward toward the catcher—as discussed in more detail below.

Figure 11:
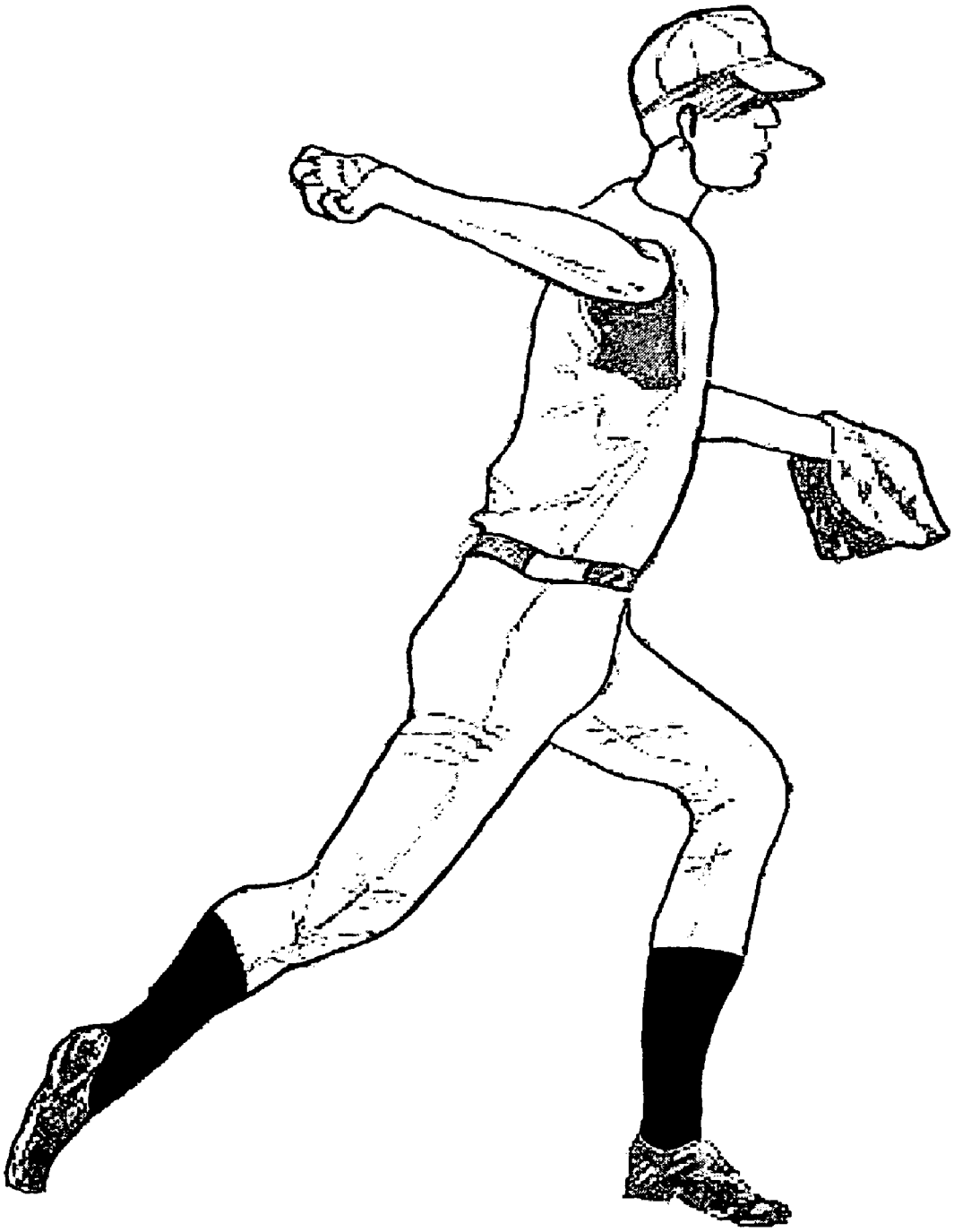
FIG. 11 illustrates a side view of a baseball pitcher during the arm cocking phase whereby the throwing arm is at a point of maximum external rotation.

Just prior to a pitcher entering the arm acceleration phase (discussed below), his/her head should be located at about center of gravity 100, or slightly behind center of gravity 100, as shown in FIG. 10. At this position, the pitcher's body core (pelvis followed by the upper trunk) begins to rotate/open to face the catcher as the pitcher's throwing arm starts externally rotating at the shoulder. As the pitcher's body core continually rotates/opens to face the catcher, the arm cocking phase ends as the pitcher's throwing shoulder reaches its point of maximum external rotation (up to about 50 degrees) as shown in the simplified illustration of FIG. 11.

(4) The Arm Acceleration Phase

Figure 12:
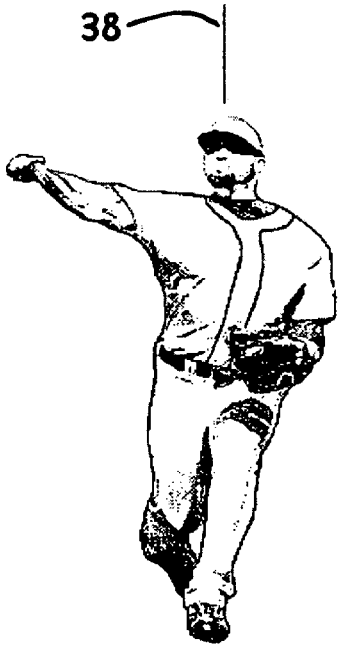
FIG. 12 illustrates a front view of a baseball pitcher during the initial part of the arm acceleration phase of the throwing motion.
Figure 13:
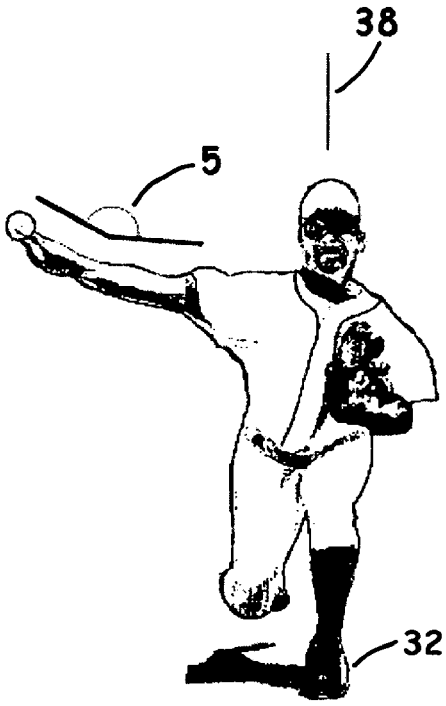
FIG. 13 illustrates a front view of a baseball pitcher with the throwing arm out to the side of the pitcher during the arm acceleration phase of the throwing motion.

The arm acceleration phase is characterized by the point of maximum shoulder external rotation until release of the baseball from the pitcher's hand out in front of the pitcher's body—as depicted in the simplified illustrations of FIGS. 12 and 13. During the arm acceleration phase, the elbow of the throwing arm is extended out (i.e., biceps extension) from an initial cocked position to a substantially straight position during ball release whereby the forearm and hand are in a final pronated position. Likewise, the pitcher's upper body travels forward toward the extended glove hand until the glove arm is tucked against the pitcher's upper body—as seen in FIG. 13. The action of taking the upper body toward the glove hand in this manner increases the centripetal force of the pitcher's body thereby maximizing the speed of the throwing arm. Basically, a pitcher wants to avoid swinging the glove hand out wide, which will spin the pitcher's upper body resulting in a loss of velocity on the pitched baseball.

With further reference to FIG. 13, when the throwing arm is out to the side of the pitcher (1) the upper arm is oriented at an angle from about 80 degrees to about a 120 degrees in relation to the longitudinal axis of the individual's body core, and (2) the elbow is suitably flexed from about 85 degrees to about 150 degrees—depending on the physical makeup of the individual (see Ref. No. 5 in FIG. 13). A suitable elbow flexion at this position is about 135 degrees. The arm position out to the side, as shown in FIG. 13, is commonly referred to as a "three quarters" position by those of ordinary skill in the art. Depending on the physical makeup of the pitcher, the arm position may actually range from a side arm position up to an overhead position of the throwing arm. At "three quarters", position, the apex of the pitcher's head, and the pitcher's center of gravity 100, are located slightly behind the stride foot 32. Once the baseball is released from the pitcher's hand, the pitcher's head and the center of gravity 100 are substantially aligned over the stride foot 32. At release, the pitcher's upper body is suitably flexed forward from a vertical position about 25 to about 45 degrees.

It should be noted that various factors contribute to the actual acceleration of the throwing arm. For instance, once the stride foot 32 has landed on the pitcher's mound the pitcher's body core must transfer energy from the legs, generated during the stride phase, to the throwing arm itself. In addition, other muscles such as the chest muscles, the latissimus dorsi, and the tricep muscles of the throwing arm contribute to this transfer of energy. Other factors that contribute to arm acceleration include, but are not necessarily limited to the flexibility of the pitcher's pelvis, stride leg stability following landing of the stride foot, torso rotation, rotator cuff strength, wrist flexion, and combinations thereof.

(5) The Arm Deceleration and (6) Follow-through Phases

Figure 14:
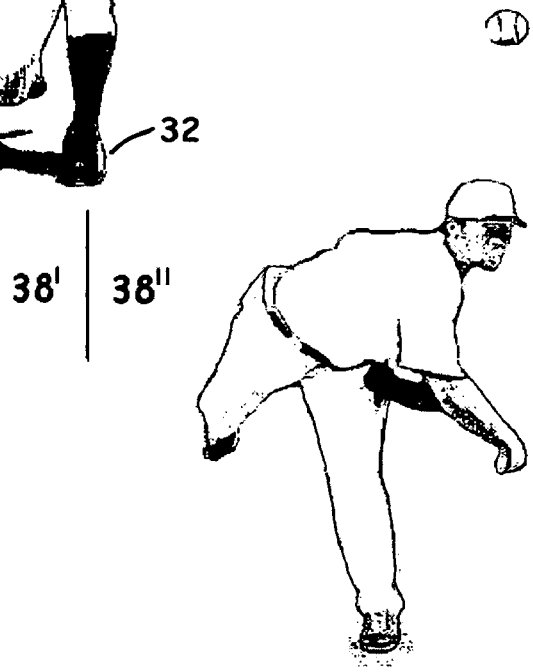
FIG. 14 illustrates a front view of a baseball pitcher during the arm deceleration phase of the throwing motion.

It is during the arm deceleration phase that the throwing arm and body core cease forward progress toward the catcher. With the planted stride leg acting as a brace for rest of the pitcher's body, the arm deceleration phase is characterized by the instant of ball release from the throwing hand until the throwing shoulder stops internally rotating. As the stride leg straightens, the body core and hips continue to flex as the non-stride leg rises off the pitcher's mound in response to the flexing body core and hip flexion—as shown in FIG. 14. As further seen in FIG. 14, the throwing arm continues to move down and across the front of the pitcher's body, a position that minimizes potential injury to the elbow and shoulder. Although the duration of the arm deceleration phase may vary depending on the age and talent level of the pitcher, the duration of the arm deceleration phase is suitably from about 0.03 to about 0.05 seconds for adult pitchers at the professional level of competition.

The follow-through phase is characterized from the point of maximum shoulder internal rotation until a pitcher regains a balanced position on the pitcher's mound. From a balanced position, a pitcher optimally faces the hitter in order to best react to a baseball hit into play by a batter.

It should be noted that various muscles assist with the deceleration of the throwing arm following release of the baseball, including, but not necessarily limited to the external rotators in the back of the shoulder, trapezium, rhomboids, and the serratus anterior that assists with keeping the throwing shoulder in socket. In addition, the biceps muscle assists in slowing the elbow to prevent injury to the elbow joint, and the legs and body core are also involved in the decelerating of the throwing arm. Each of these muscle groups, the elbow joint of the throwing arm, and the throwing shoulder joint perform extreme compression to slow the throwing arm. Thus, the throwing shoulder and elbow joint may experience extreme unnatural stresses during the arm deceleration phase if the various body parts are not optimally aligned—meaning that the various body parts are in less than optimum synchronization. Therefore, the present training apparatus 10 is advantageous because it provides a directional path and directional alignment of the stride foot 32 allowing for the synchronization of the various body parts during the act of throwing, including during the arm deceleration and follow-through phases.

As noted, incorrect throwing mechanics may increase the stress on the throwing shoulder and throwing elbow, resulting in increased injury and/or risk for injury to the shoulder, arm, wrist and elbow. For example, the joint of the throwing shoulder may experience an internal rotation up to about 60 degrees following release of a ball from the throwing hand. Thus, the greatest kinetic and kinematic values typically occur during the arm cocking phase, arm acceleration phase, and arm deceleration phase, implying that these are the phases where overuse injuries to the shoulder, arm and elbow are likely to occur. Other undesirable kinematic parameters that may correlate to increased shoulder force or trauma include, but are not necessarily limited to:

(1) the landing spot of the stride foot 32 on the pitcher's mound (a) in a closed position in relation to line 38 (area $\mathbf{38}^{I}$), or (b) in an open position in relation to line 38 (area $\mathbf{38}^{II}$), in FIG. 13; and (2) the pointing of the stride foot toes in the direction of area $\mathbf{38}^{I}$ or area $\mathbf{38}^{II}$. Other undesirable kinematic parameters that may correlate to increased elbow force or trauma include, but are not necessarily limited to: (1) increased shoulder rotation at the instant the stride foot 32 contacts the pitcher's mound; and (2) increased shoulder horizontal adduction. By teaching a pitcher how to effectively maneuver his/her stride foot 32 and other body parts in space in relation to the configuration of the training apparatus 10, a pitcher may suitably optimize the synchronization of the various body parts helping to avoid physical injury while maximizing throwing velocity, throwing accuracy, and stamina.

Typical physical injuries produced by less that optimum throwing mechanics may include, but are not necessarily limited to shoulder injuries, elbow injuries, arm injuries, hamstring injuries, hip injuries. Shoulder injuries contemplated herein include for example, rotator cuff tears, impingement of the posterior cuff undersurface, and tendentious. Contemplated elbow injuries include, but are not necessarily limited to tendentious, damage to the ulnar collateral ligament, muscle strains, muscle tears, tendon tears, and bone chips.

Discussion of Operation of the Training Apparatus

With reference now to FIGS. 15-28, operation of the training apparatus 10 is discussed as it relates to developing each of the above described attributes of the overhand throwing motion.

As previously determined, the location of a pitcher's center of gravity 100 through each phase of the throwing motion contributes to either optimum or less than optimum throwing mechanics. Thus, an advantageous feature of the present training apparatus 10 includes controlling and/or monitoring a pitcher's center of gravity 100 through the various throwing phases by specifically orienting the location of the pitcher's head relative to the pitcher's stride foot 32 as the stride foot 32 is directed along the training apparatus 10. More particularly, the training apparatus 10 may be used to control and/or monitor a pitcher's center of gravity 100 by specifically orienting the location of the pitcher's head in relation to the back foot 50 and the stride foot 32 as the stride foot 32 travels along the upper surface 24 of the training apparatus 10. Even more particularly, the present training apparatus 10 provides a visual tool for a pitcher by indicating to the pitcher (1) the desired location of his/her head above the training apparatus 10 during the transition between the windup phase and stride phase—which may or may not be indicated or otherwise marked at a point on the upper surface 24 (see the exemplary diamond shaped indicator on the upper surface 24 at FIG. 2); and (2) the moment to begin pushing/driving off the pitching rubber 40 toward the catcher as the stride foot 32 reaches a specified point along the upper surface 24 during the stride phase—which may or may not be indicated or otherwise marked at a point on the upper surface 24.

For simplicity, the back foot 50, stride foot 32 and pitcher's head may be thought of as three points on a (x,y) plane that form a triangle. Since at least part of the back foot 50 remains planted against the pitching rubber 40 until the stride foot 32 lands on the pitcher's mound during the stride phase, only the position of the points of the triangle defining the stride foot 32 and pitcher's head change during the stride phase.

Figure 17:
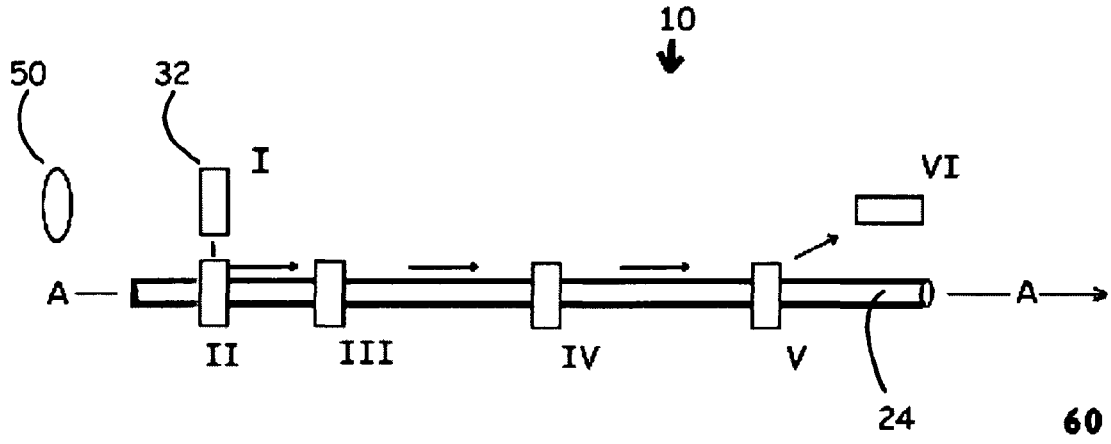
FIG. 17 illustrates a top view of another simplified path of an individual's stride foot during the act of throwing as the stride foot travels along an embodiment of the training apparatus.
Figure 18:
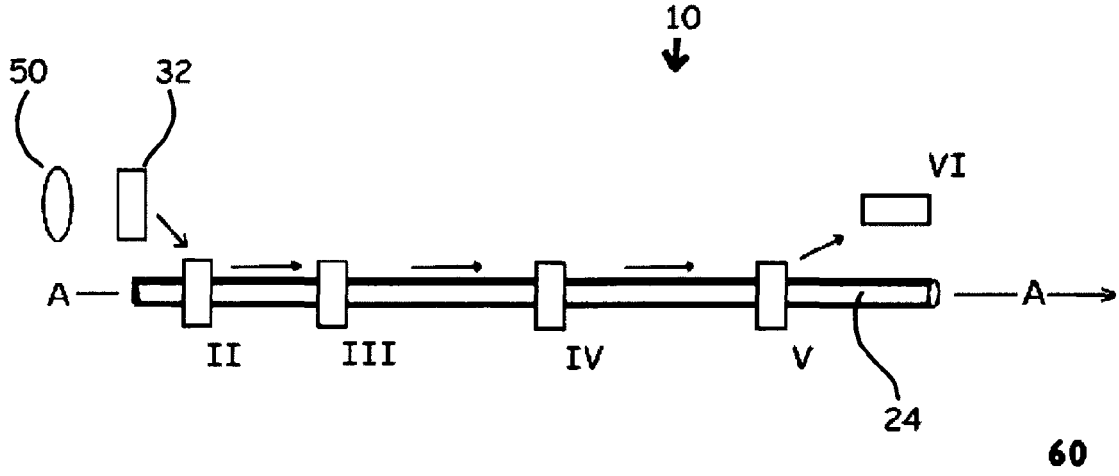
FIG. 18 illustrates a top view of another simplified path of an individual's stride foot during the act of throwing as the stride foot travels along an embodiment of the training apparatus.

With particular reference now to FIGS. 15-18, representative directional paths for a pitcher's stride foot 32 through the windup and stride phases are shown. In one embodiment, the stride foot 32 may take a direct linear path down and forward toward the upper surface 24 from a point of maximum knee lift—as illustrated FIGS. 15 and 18. In another embodiment, the pitcher's stride foot 32 may take a curved path down and forward to the upper surface 24 from a point of maximum knee lift—as illustrated in FIG. 16. In still another embodiment, the stride foot 32 may approach the upper surface 24 along a path substantially perpendicular to the longitudinal axis A-A—as illustrated in FIG. 17.

Regardless of the horizontal path, the stride foot 32 should suitably follow a general vertical path as illustrated in FIGS. 15 and 16: (a) starting with the feet aligned in parallel fashion adjacent the training apparatus 10, i.e., set position, the stride foot 32 is lifted from a starting position (I) to a maximum altitude (II) as the back foot 50 remains planted against the pitching rubber 40; (b) from maximum altitude (II), the stride foot 32 is directed toward the catcher in a manner effective to produce a soft gliding action of the stride foot 32 along the upper surface 24 in a substantially straight downward path 60 (see III-V) toward the catcher until the pitcher's hips begin to rotate open allowing the stride foot 32 to move offline from the training apparatus 10 to an optimum landing location (VI) on the pitcher's mound adjacent the training apparatus 10. Herein, a "soft gliding action" refers to the stride foot 32 gently or softly touching the upper surface 24 of the training apparatus 10 in a controlled manner during the stride phase of the throwing motion. By performing a soft gliding action, the training apparatus 10 influences the tempo of the pitcher's various body parts, designed to prevent a pitcher from rushing through the various throwing phases thereby prematurely transferring the pitcher's weight out in front of his/her center of gravity 100 toward the catcher.

Figure 20:
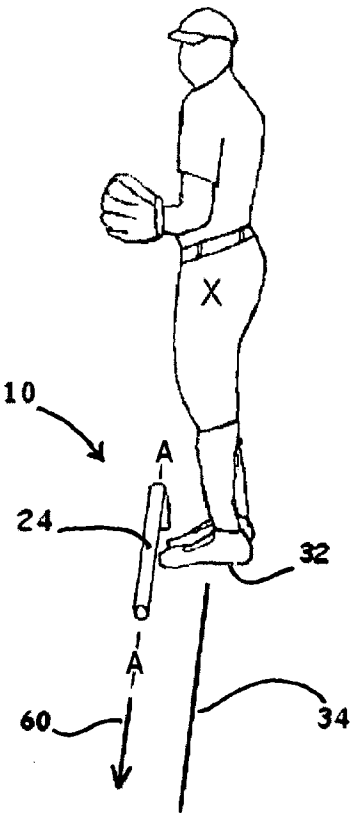
FIG. 20 illustrates a front view of a baseball pitcher in a stretch position adjacent an embodiment of the training apparatus.
Figure 19:
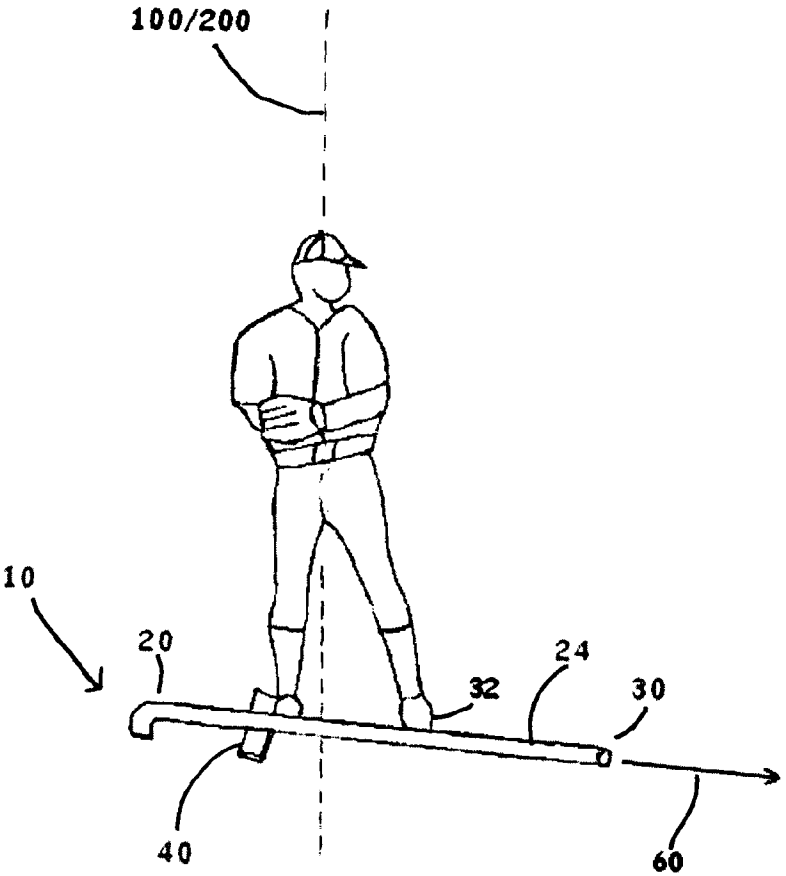
FIG. 19 illustrates a front side view of a baseball pitcher in a stretch position adjacent an embodiment of the training apparatus.

With particular reference to the simplified illustrations of FIGS. 19-20, a pitcher first places the training apparatus 10 on a pitcher's mound in an upright manner wherein at least a portion of the upper surface 24 is located between the pitching rubber 40 and the catcher. In another embodiment, the entire training apparatus 10 may be placed between the pitching rubber 40 and the catcher. When utilizing a training apparatus 10 as depicted in FIGS. 1-3, the longitudinal axis A-A of the elongated section 14 is suitably aligned with path 60 toward the catcher—as best illustrated in FIG. 20. When utilizing a training apparatus 10 as depicted in FIGS. 4 and 5, the downward slope of the upper surface 24 is suitably aligned with path 60 toward the catcher.

In one embodiment, a pitcher may start from a full windup position. In another embodiment, a pitcher may start from a set position with the back foot contacting the throwing rubber 40 as illustrated in FIG. 19. In either case, a pitcher suitably positions himself/herself adjacent the training apparatus 10 whereby the second end 30 terminates at a point about equal to or greater in length than the pitcher's optimum stride length from his/her starting position.

As FIG. 20 illustrates, a pitcher suitably stands at set position adjacent the training apparatus 10, his/her coronal plane lying along path 34 in parallel alignment with path 60. At set position, the pitcher's center of gravity 100 is approximately aligned with the pitcher's center line 200—as shown in FIG. 19. Likewise, the side of the pitcher's lead hip (marked as "X" in FIG. 20) faces the catcher at set position and continues to face the catcher until the latter part of the stride phase, e.g., when the pitcher's hips rotate open as discussed above. Thus, the training apparatus 10 may be used as a visual tool at initial set up to at least (1) align the pitcher's lead hip with the catcher; and (2) ensure a minimum stride length be providing a particular minimum length of upper surface 24 between the pitcher and the catcher.

Figure 22:
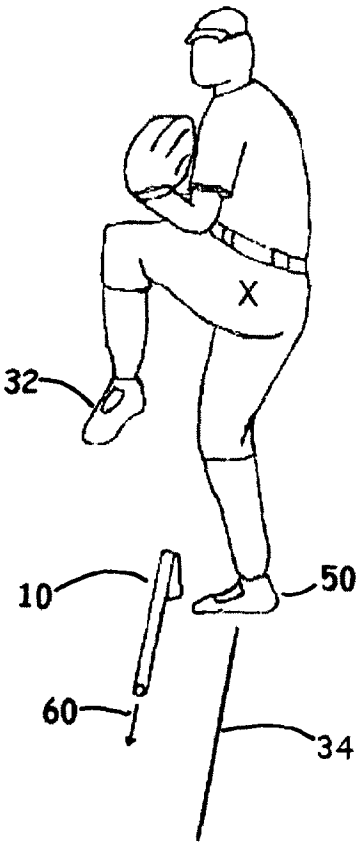
FIG. 22 illustrates a front view of a baseball pitcher adjacent an embodiment of the training apparatus during the windup phase of the throwing motion.
Figure 21:
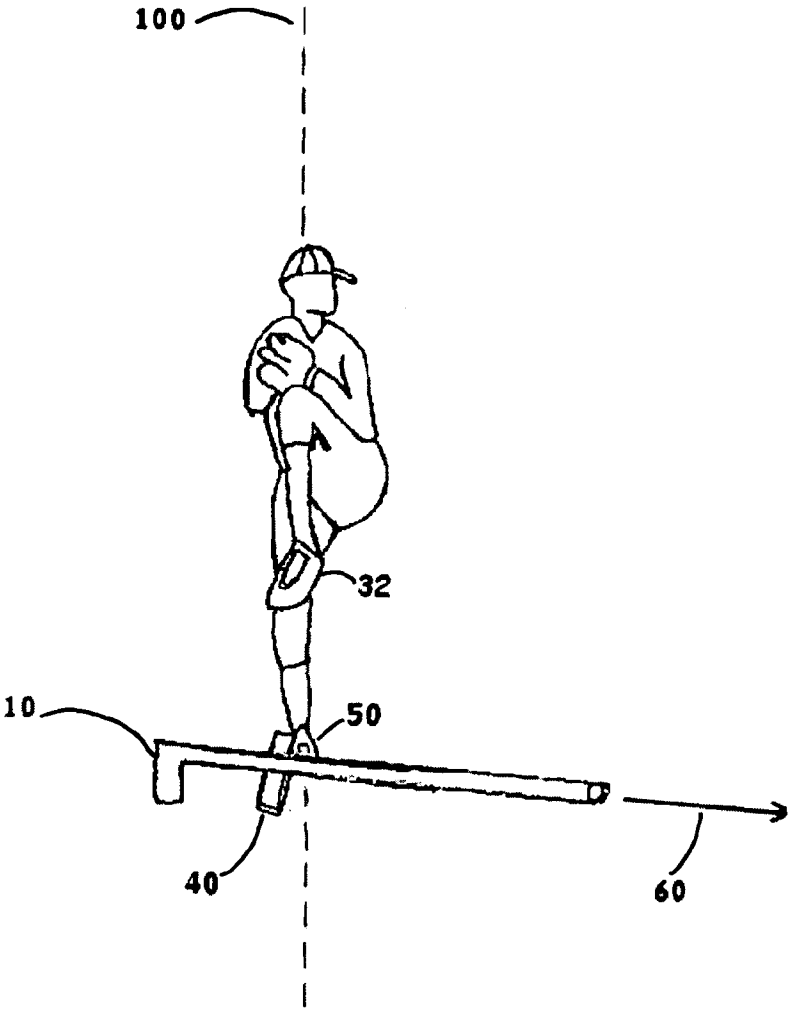
FIG. 21 illustrates a front side view of a baseball pitcher adjacent an embodiment of the training apparatus during the windup phase of the throwing motion.
Figure 23:
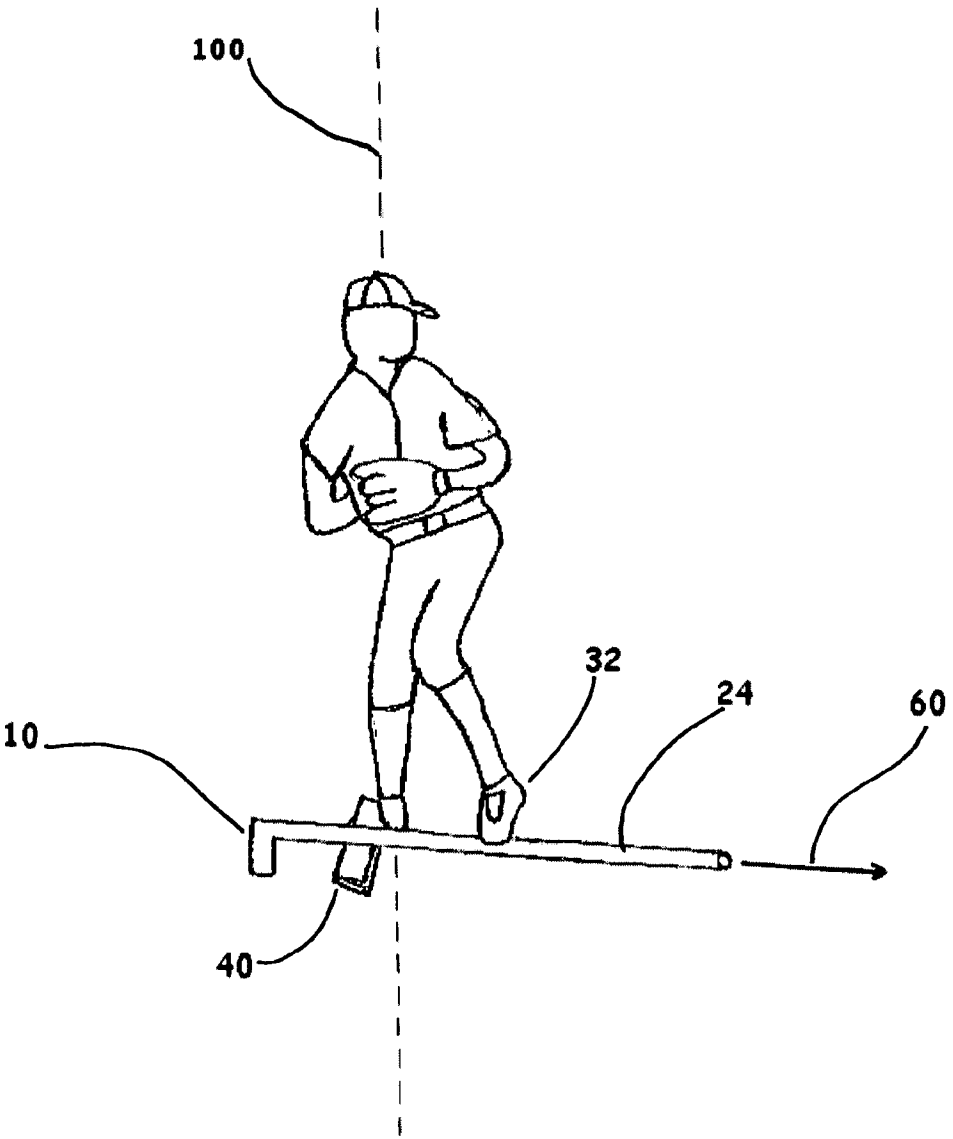
FIG. 23 illustrates a front side view of a baseball pitcher during the stride phase of the overhand throwing motion whereby the pitcher's stride foot is shown making initial contact with the upper surface of an embodiment of the training apparatus.

With reference now to the simplified illustrations of FIGS. 21 and 22, which depict a pitcher at maximum knee lift during the windup phase, a pitcher's center of gravity 100 is suitably directed toward the back foot 50 and pitching rubber 40 whereby the pitcher's weight is optimally balanced on the non-stride leg in a load position in preparation to push off of the pitching rubber 40 toward the catcher. In addition, the maximum altitude of a pitcher's stride foot 32 at maximum knee lift is necessarily greater than the altitude or height of the upper surface 24 adjacent the individual's stride foot 32 as illustrated in FIGS. 21 and 22. Thus, the training apparatus 10 may be used as a visual tool during the windup phase to at least (1) ensure proper head placement substantially over the back foot 50; (2) maintain the pitcher's head at a desired altitude above the training apparatus 10 during the knee lift; and (3) ensure that the pitcher raises his/her stride foot 32 at least a minimum altitude during the knee lift.

As discussed above, the pitcher's head should remain substantially balanced and/or still at the back foot 50 and pitching rubber 40 as the pitcher initially directs his/her stride foot 32 from maximum knee lift down and toward the upper surface 24 until the stride foot 32 draws nearer the catcher than the pitcher's stride knee. Thus, in one embodiment the training apparatus 10 may be situated so that the pitcher's stride foot 32 contacts the upper surface 24 at the moment in space where the stride foot 32 draws nearer the catcher than the pitcher's stride knee along path 60—as shown in the simplified illustration of FIG. 23. As a result, the dimensions of the training apparatus 10 may be modified over time as necessary and the training apparatus 10 may be used as a visual tool during the transition from the windup phase to the stride phase to at least (1) locate the position in space where a particular pitcher's stride foot 32 should draw nearer the catcher than the pitcher's stride knee; and (2) ensure proper head placement substantially balanced and/or still at the back foot 50 and pitching rubber 40 as the stride foot 32 is initially moved down and forward toward the upper surface 24.

Figure 25:
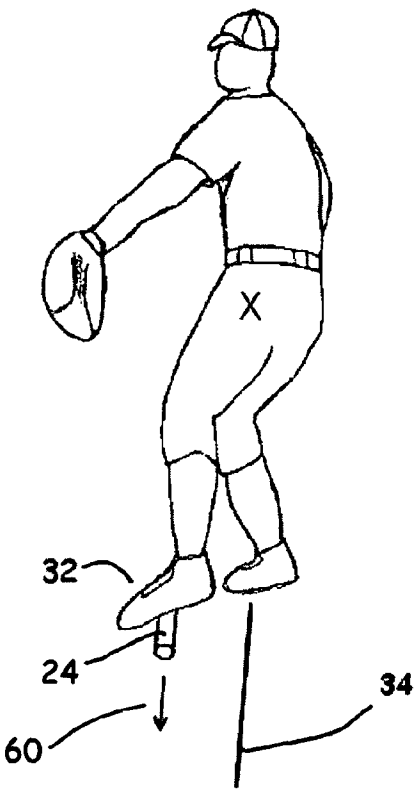
FIG. 25 illustrates a front view of a baseball pitcher during the stride phase of the overhand throwing motion whereby the pitcher's stride foot is shown contacting the upper surface of an embodiment of the training apparatus.
Figure 24:
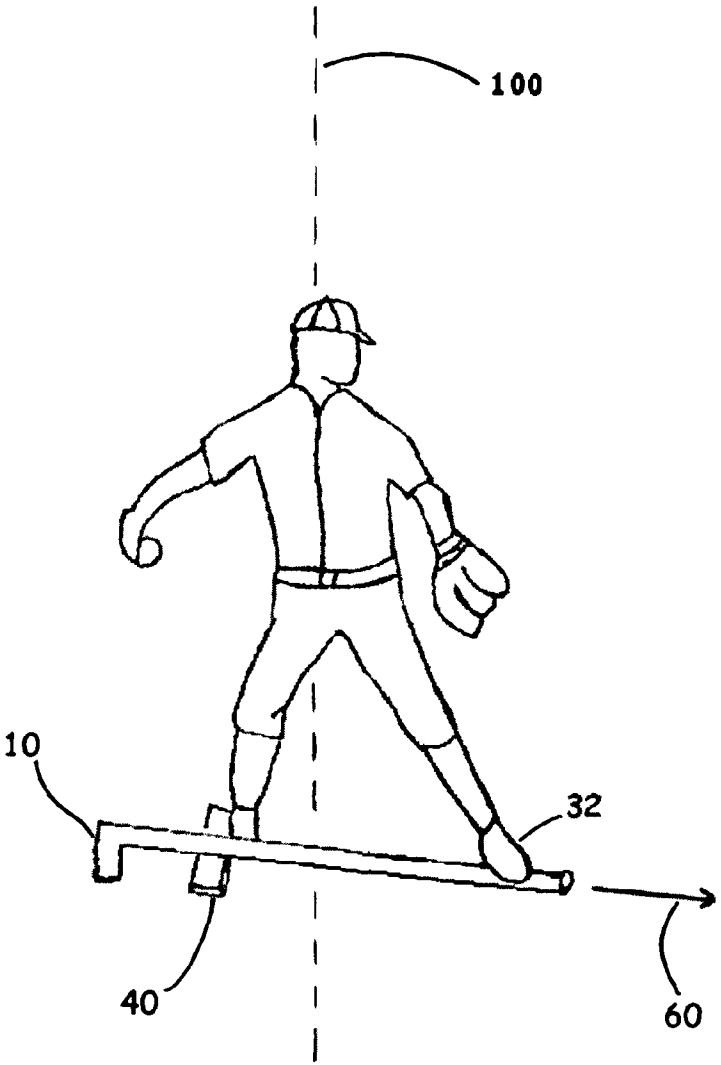
FIG. 24 illustrates a front side view of a baseball pitcher during the stride phase of the overhand throwing motion whereby the pitcher's stride foot is shown contacting the upper surface of an embodiment of the training apparatus.

Once the stride foot 32 contacts the upper surface 24, the stride foot 32 and the pitcher's upper body begin to move toward the catcher at a similar rate (the stride foot 32 along path 60 and the upper body along path 34—as shown in FIG. 25). It is advantageous for a pitcher to guide the stride foot 32 lightly or softly along the upper surface 24 minimizing the amount of force being applied to the training apparatus 10. By maneuvering the stride foot 32 along the upper surface 24 in a soft gliding motion, the pitcher ensures a soft and controlled landing of the stride foot 32 on the pitcher's mound, suitably aligning the upper body as discussed above as the pitcher enters the remaining phases of the throwing motion. Thus, the training apparatus 10 may be used as a visual tool during the stride phase to at least (1) direct a pitcher's upper body toward the catcher along path 34, and (2) locate the position in space where a particular pitcher's stride foot 32 should be redirected off from path 60 toward the optimum landing spot on the pitcher's mound. Likewise, because the stride foot 32 travels down the upper surface 24 until the hips rotate open to face the catcher, the training apparatus 10 is effective to ensure that the stride foot 32 does not land in a closed position, i.e., area 38$^{I}$ shown in FIG. 13.

Figure 26:
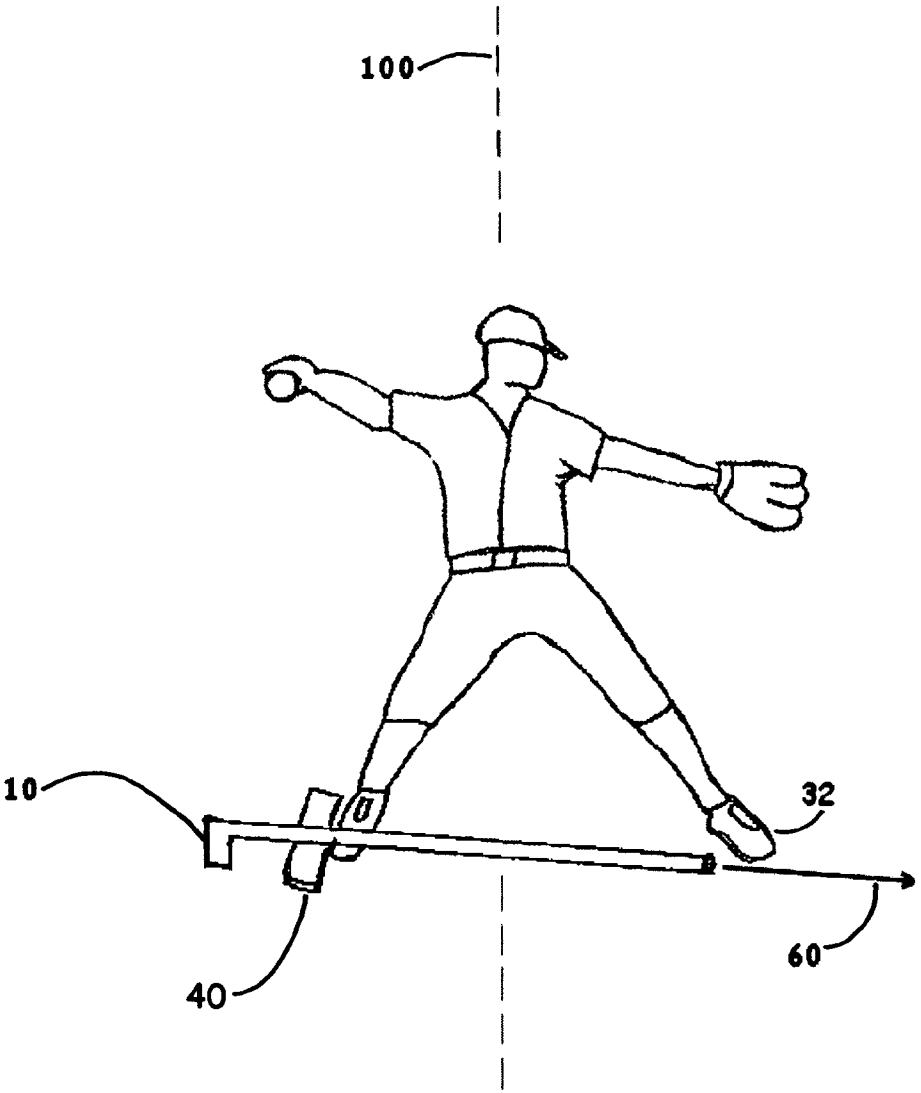
FIG. 26 illustrates a front side view of a baseball pitcher during the arm cocking phase of the overhand throwing motion whereby the pitcher's stride foot is shown in a landing spot adjacent a second end of an embodiment of the training apparatus.
Figure 27:
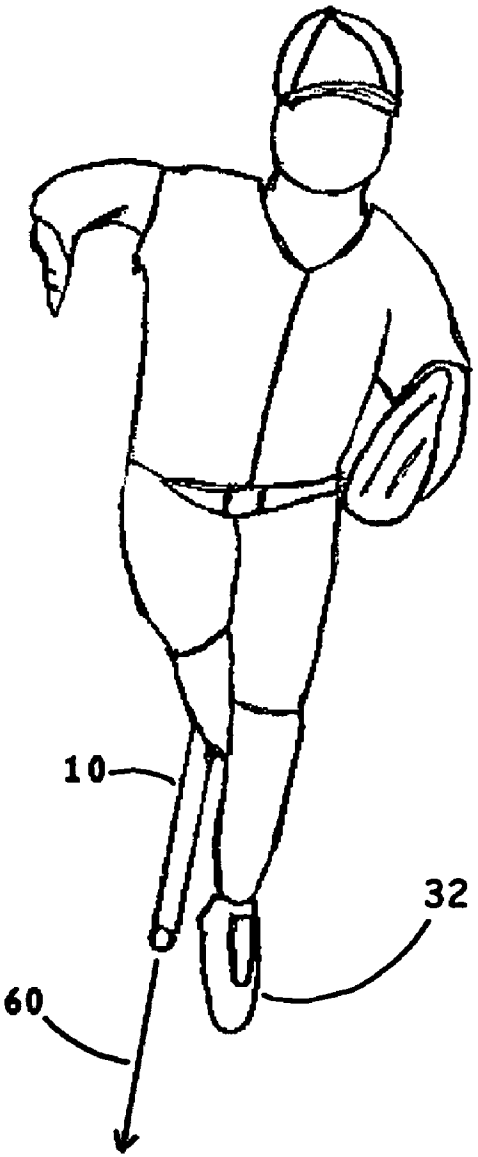
FIG. 27 illustrates a front view of a baseball pitcher during the arm deceleration phase of the overhand throwing motion whereby the pitcher's stride foot is shown in a landing spot adjacent a second end of an embodiment of the training apparatus.
Figure 28:
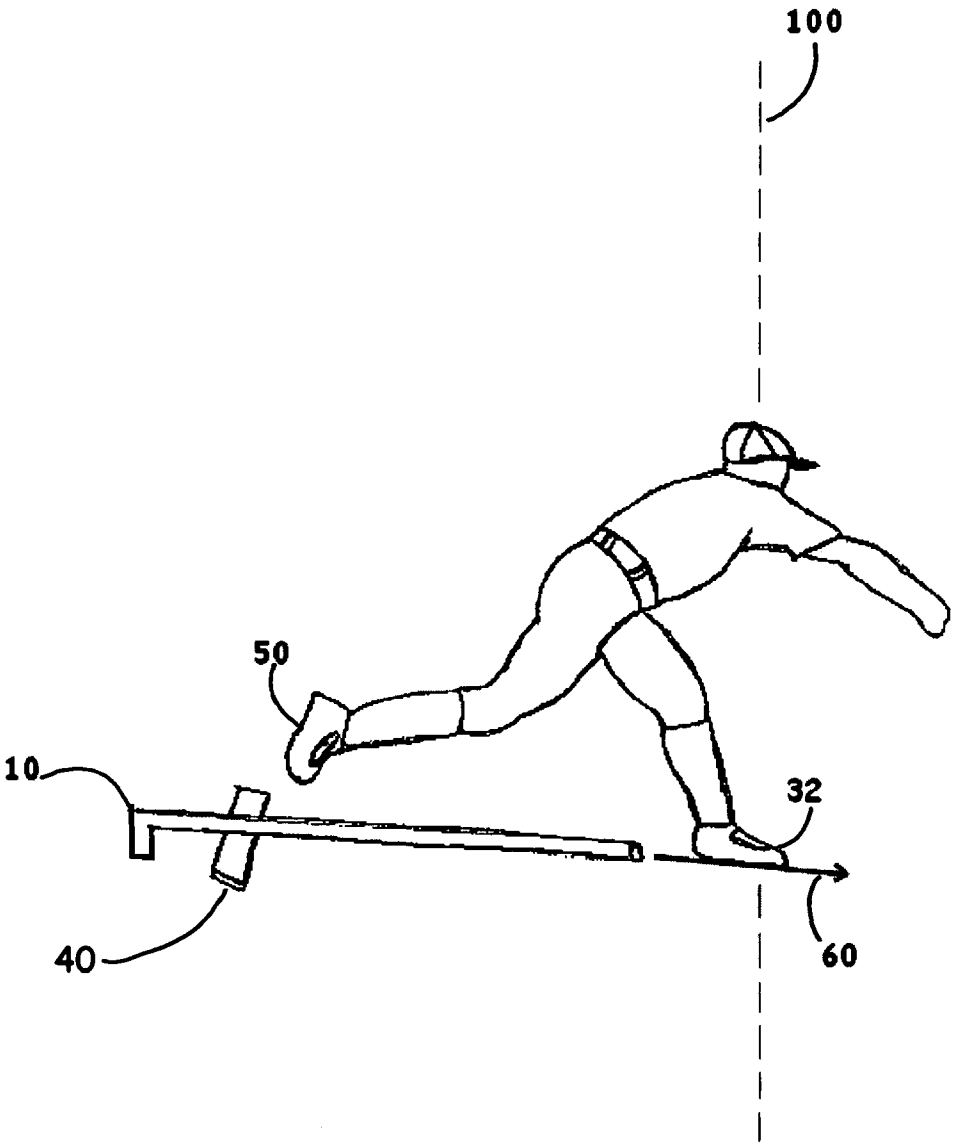
FIG. 28 illustrates a side view of a baseball pitcher during the follow-through phase of the overhand throwing motion incorporating an embodiment of the training apparatus.

As the stride foot 32 lands on the pitcher's mound adjacent the training apparatus 10, the pitcher's arms should separate to an extended position as shown in FIG. 26. Suitably, the throwing arm is elevated to at least shoulder level when the stride foot 32 contacts the pitcher's mound to ensure that the throwing hand reaches an ideal cocked position behind the pitcher's head. As shown, the glove arm is suitably substantially extended out toward the catcher. Thus, the training apparatus 10 may further be used as a visual tool to ensure that a pitcher's arms are extended along path 34 as the stride foot 32 contacts the pitcher's mound. Linear alignment of the arms in combination with the linear movement of the upper body along path 34 toward the glove hand during the arm cocking, arm acceleration and arm deceleration phases assists pitcher's to avoid swinging the glove hand out wide off path 34, thereby decreasing the risk of possible injury and/or loss of velocity on the pitch.

In addition, a soft gliding motion of the stride foot 32 also assists a pitcher in both (1) maintaining the apex of his/her head at about center of gravity 100 or slightly behind center of gravity 100 during the arm cocking phase just prior to entering the arm acceleration phase, and during the arm acceleration phase once the throwing arm reaches the "three quarters" position described above; and (2) aligning his/her head and center of gravity 100 over the stride foot 32 once the baseball is released from the pitcher's hand.

During the follow-through phase, as a pitcher regains a balanced position on the pitcher's mound, the pitcher suitably faces the catcher whereby the pitcher's feet lie on the pitchers' mound on opposite sides of path 60. Depending on the length of the training apparatus 10, a pitcher's feet may be located beyond the training apparatus 10 nearer the catcher, or in the alternative, the pitcher may straddle the training apparatus 10. From this finish position, a pitcher optimally faces the hitter in order to best field a hit ball. Thus, the training apparatus 10 may be used as a visual tool during the follow-through phase to at least ensure that a pitcher's non-stride foot lands on the opposite side of path 60 from the stride foot 32.

As previously stated, the altitude or height of both ends 20, 30 as well as the length and slope of the elongated section 14 and/or upper surface 24 may be adjusted to accommodate a particular individual as desired. Thus, it is contemplated herein that each pitcher may first begin using a standardized training apparatus 10 having set dimensions. Thereafter, the height, length and slope of the training apparatus 10 may be adjusted to optimize a particular pitcher's throwing mechanics. Adjustment of the training apparatus 10 may be accomplished following instructor observation or following individual pitcher use, or both.

Since the training apparatus 10 does not disrupt the pitcher's natural relationship with the pitcher's mound while delivering a pitch to the catcher, it is further contemplated that the training apparatus 10 may be used in actual game type situations as desired, e.g., at actual game speed in a simulated game setting. Game speed use of the training apparatus 10 allows for real time adjustment in height, length and slope of the training apparatus 10 by a pitching instructor and/or the actual pitcher as a means for fine-tuning the optimum directional path in space for that particular pitcher's stride foot 32.

It is also contemplated that the training apparatus 10 be configured for use by a football quarterback. In general, football passing is similar to baseball pitching, but with a lesser knee lift of the stride leg during the windup phase. Typically, quarterbacks have less ball speed, less arm angular velocity, and less trunk angular velocity. In addition, these maximum angular velocities occur later for quarterbacks than baseball pitchers, although maximum shoulder external rotation typically occurs earlier in quarterbacks. Quarterbacks generally have shorter strides and stand more erect, i.e., less forward flexion of the upper body than pitchers, at ball release, thereby requiring less distance of the upper surface 24 than typically required by the same individual performing a baseball pitch.

The embodiments described above will be better understood with reference to the following non-limiting examples, which are illustrative only and not intended to limit the present application to a particular embodiment.

Example 1

In a first non-limiting example, an adjustable standardized training apparatus 10 for use by adult male professional baseball pitchers, as shown in FIG. 1, is provided including the following dimensions:

| | |
|---|---|
| Altitude/Height at First End 20: | about 8.0 inches<br>about 20 cm |
| Altitude/Height at Second End 30: | Configured to terminate at about the surface of the pitcher's mound |
| Length of Substantially Straight Elongated Section 14 and upper surface 24: | about 5.5 feet<br>about 167 cm |
| Width of Upper Surface 24: | about 1 inch<br>about 2.54 cm |

Example 2

In another non-limiting example, a training apparatus 10, as shown in FIG. 1 including a telescoping first rising section 12 and a telescoping elongated section 14, is provided including the following dimensions:

| | |
|---|---|
| Maximum Altitude/Height at First End 20: | about 12 inches<br>about 30.5 cm |
| Minimum Altitude/Height at First End 20: | about 6.0 inches<br>about 15.2 cm |
| Altitude/Height at Second End 30: | Configured to terminate at about the surface of the pitcher's mound |
| Maximum Length of Substantially Straight Elongated Section 14 and upper surface 24: | about 7.0 feet<br>about 213.4 cm |
| Minimum Length of Substantially Straight Elongated Section 14 and upper surface 24: | about 4 feet<br>about 122 cm |
| Width of Upper Surface 24: | about 2 inches<br>about 5.08 cm |

Persons of ordinary skill in the art will recognize that many modifications may be made to the embodiments described above without departing from the broad inventive concept thereof. The embodiments described herein are meant to be illustrative only and should not be taken as limiting the invention, which is defined in the following claims.

I claim:

1. A method for dictating the path in space of a person's stride foot while performing the overhand throwing motion, the person being defined by a center line that bisects the body vertically into equal left and right sides, the method comprising:

providing a training apparatus on a throwing surface, the training apparatus comprising a first end, a second end, and a guiding surface interconnecting the first end to the second end, the guiding surface being adjustable in altitude; and performing the act of throwing toward a target including (a) standing on the throwing surface adjacent the training apparatus in a starting position, (b) directing the stride foot from the throwing surface to a contact point on the guiding surface wherein the side of the person's lead hip is on a substantially direct path toward the target, (c) directing the stride foot along the guiding surface toward the second end until the person's hips begin to rotate open toward the throwing target defining the moment of removal of the stride foot off the guiding surface, and (d) from the moment of removal directing the stride foot to a landing spot on the throwing surface adjacent the training apparatus.

2. The method of claim 1 wherein the slope of the guiding surface is different than the slope defining the throwing surface.

3. The method of claim 1 whereby a natural relationship with the throwing surface is maintained while performing the overhand throwing motion.

4. The method of claim 1 wherein the training apparatus is operationally configured to prevent the premature landing of the stride foot upon the throwing surface during the stride phase of the overhand throwing motion.

5. The method of claim 1 wherein the stride foot is directed along the guiding surface while applying the least amount of pressure from the stride foot upon the guiding surface during the stride phase of the overhand throwing motion.

6. The method of claim 1 wherein the maximum altitude of the training apparatus establishes the minimum altitude of the stride foot during the initial leg lift of the windup phase of the overhand throwing motion.

7. The method of claim 1 further comprising preventing the person's center of gravity from shifting forward toward the second end past the center line as the stride foot is directed along the guiding surface.

* * * * *